US006030742A

United States Patent [19]

Bourdelais et al.

[11] Patent Number: 6,030,742

[45] Date of Patent: Feb. 29, 2000

[54] SUPERIOR PHOTOGRAPHIC ELEMENTS INCLUDING BIAXIALLY ORIENTED POLYOLEFIN SHEETS

[75] Inventors: Robert P. Bourdelais, Pittsford; Thaddeus S. Gula, Rochester; Peter T. Aylward, Hilton; Sandra J. Dagan, Churchville; John F. Sawyer, Fairport; Geoffrey Mruk, Rochester, all of N.Y.

[73] Assignee: Eastman Kodak Company, Rochester, N.Y.

[21] Appl. No.: 09/197,868

[22] Filed: Nov. 23, 1998

[51] Int. Cl.[7] ..... G03C 8/52; G03C 1/765; G03C 1/79

[52] U.S. Cl. ..... 430/201; 430/200; 430/207; 430/536; 430/538; 430/496

[58] Field of Search ..... 430/536, 538, 430/496, 201, 207, 200; 347/106

[56] References Cited

U.S. PATENT DOCUMENTS

| | | | |
|---|---|---|---|
| 5,244,861 | 9/1993 | Campbell et al. | 430/201 |
| 5,275,854 | 1/1994 | Maier et al. . | |
| 5,434,039 | 7/1995 | Nagata et al. . | |
| 5,443,915 | 8/1995 | Wilkie et al. . | |
| 5,466,519 | 11/1995 | Shirakura et al. . | |
| 5,514,460 | 5/1996 | Surman et al. . | |
| 5,853,965 | 12/1998 | Haydock et al. . | |
| 5,866,282 | 2/1999 | Bourdelais et al. | 430/538 |
| 5,874,205 | 2/1999 | Bourdelais et al. . | |
| 5,888,643 | 3/1999 | Aylward et al. | 430/538 |
| 5,888,683 | 3/1999 | Gula et al. | 430/538 |

FOREIGN PATENT DOCUMENTS

| | | |
|---|---|---|
| 0 880 065 A1 | 11/1998 | European Pat. Off. . |
| 0 880 067 A1 | 11/1998 | European Pat. Off. . |
| 0 880 069 A1 | 11/1998 | European Pat. Off. . |
| 2325749 | 12/1998 | United Kingdom . |
| 2325750 | 12/1998 | United Kingdom . |

*Primary Examiner*—Richard L. Schilling
*Attorney, Agent, or Firm*—Paul A. Leipold

[57] ABSTRACT

The invention relates to a photographic element comprising at least one photosensitive silver halide layer comprising at least one dye forming coupler, a support comprising paper having laminated thereto a top and bottom sheet comprising biaxially oriented polyolefin sheets, wherein said photographic element has a surface roughness of between 0.15 and 0.50 mm and an average stiffness of between 150 and 300 millinewtons, a stiffness ratio between machine direction and cross direction of between 0.8 and 1.2 at between 20 and 70% humidity, a maximum curl value of 10 curl units, said photographic element has a back roughness of between 0.30 and 2.00 mm, and has a tear strength of between 300 and 900 N.

37 Claims, No Drawings

SUPERIOR PHOTOGRAPHIC ELEMENTS INCLUDING BIAXIALLY ORIENTED POLYOLEFIN SHEETS

FIELD OF THE INVENTION

This invention relates to photographic materials. In a preferred form it relates to laminated base materials for photographic elements.

BACKGROUND OF THE INVENTION

In the formation of color photographic paper it is known that the base paper has applied thereto a layer of polymer, typically polyethylene. This layer serves to provide waterproofing to the paper, as well as providing a smooth surface on which the photosensitive layers are formed. The formation of a suitably smooth surface is difficult, requiring great care and expense to ensure proper laydown and cooling of the polyethylene layers. One defect in prior formation techniques is caused when an air bubble is trapped between the forming roller and the polyethylene layer which will form the surface for casting of photosensitive materials. This air bubble will form a pit that will cause a defect in the photographic performance of photographic materials formed on the polyethylene. It would be desirable if a more reliable and improved surface could be formed at less expense.

In color papers there is a need for providing color papers with improved resistance to curl. Present color papers will curl during development and storage. Such curl is thought to be caused by the different properties of the layers of the color paper, as it is subjected to the developing and drying processes. Humidity changes during storage of color photographs lead to curling. There are particular problems with color papers when they are subjected to extended high humidity storage such as at greater than 50% relative humidity. Extremely low humidity of less than 20% relative humidity also will cause photographic papers to curl.

In photographic papers the polyethylene layer also serves as a carrier layer for titanium dioxide and other whitener materials, as well as tint materials. It would be desirable if the colorant materials rather than being dispersed throughout the polyethylene layer could be concentrated nearer the surface of the layer where they would be more effective photographically. In U.S. application Ser. No. 08/862,708 (Bourdelais et al.) filed May 23, 1997, a composite, photographic material with laminated biaxially oriented polyolefin sheets has been proposed. While this invention does provide a solution to the sensitivity of photographic paper to humidity, it uses standard photographic base paper whose roughness is replicated on the surface of the imaging element. Traditional cellulose paper base has a particularly objectionable roughness in the spatial frequency range of 0.30 to 6.35 mm. In this spatial frequency range, a surface roughness average greater than 0.50 $\mu$m can be objectionable to consumers. Visual roughness greater than 0.50 $\mu$m is usually referred to as orange peel. It would be desirable if orange peel roughness could be minimized in the laminated photographic base paper.

It has been proposed in U.S. Pat. No. 5,244,861 to utilize biaxially oriented polypropylene laminated to cellulose grade paper for use as a reflective receiver for thermal dye transfer imaging process. The preferred bonding agent in U.S. Pat. No. 5,244,861, to bond the biaxially oriented polypropylene sheets to paper, is low density polyethylene melt extruded from a slit die. Because of the high processing temperatures required for LDPE, shrinkage of the biaxially oriented sheet is common in the melt extrusion process.

Shrinkage can cause undesirable changes in the Poisson ratio of the laminated receiver, as well as a reduction in the optical performance of the receiver. It would be desirable to reduce the extrusion temperature of the bonding layer and maintain acceptable integrity of the laminated support.

During the manufacturing process for photographic papers while the laminated photographic support is being emulsion coated and slit, the laminated structure is subjected to various forces in manufacturing that will cause delamination of the polypropylene sheet from the paper. The delamination may be a result of bonding layer failure to either the base paper or the polypropylene sheet. Also, when the photographic paper is being processed and finished at photofinishers, the laminated structure is also subjected to various forces in both the wet and dry state. Furthermore, when the photographic paper is kept for years by the final customer, the laminated structure is subjected to forces created by temperature and humidity changes that could cause delamination of the biaxially oriented polyolefin sheets from the cellulose paper base. Delamination of the biaxially oriented sheet from the paper during manufacturing will result in the product being wasted, thus increasing the cost of manufacture. Delamination of the biaxially oriented sheet from the paper at either the photofinishing operation or in the final customer format will result in a loss in the appearance of the image and the reduction of the commercial value of the photograph. It would be desirable if a melt extruded bonding adhesive could prevent delamination of biaxially oriented sheets from the base paper during manufacture of a laminated imaging support and in the final customer format.

Prior art photographic support materials typically utilize melt extruded polyethylene to waterproof the paper during the wet processing of images during the image development process. The gelatin based light sensitive silver halide emulsion generally adheres well to the polyethylene layer during manufacturing and wet processing of images. It would be desirable if a biaxially oriented sheet contained an integral bonding layer to provide emulsion adhesion during emulsion coating and the wet processing of images during the image development step.

Commercially available photographic paper typically has a single color logo identifying the manufacturer of the photographic paper. This logo is applied to the backside of the photographic paper and is generally printed on the base paper before the polyethylene coating is applied. The present product is practically limited to a single color because the present production machines are limited by cost and space limitations to a single color press for the printing of indicia onto the back of the base paper. It would be desirable if a low cost method of applying multiple colors to the backside of photographic paper were available.

Present photographic papers are typically designed to have a life of one hundred years or greater to preserve images across several generations. Present photographic papers generally being constructed of polyethylene coated cellulose paper can be easily damaged, torn, or abraded as images are viewed and handled by consumers over one hundred years. It would be desirable if a photographic paper support was more durable, offering the consumer a photographic image that would better withstand one hundred years of handling and viewing.

PROBLEM TO BE SOLVED BY THE INVENTION

There remains a need for an improved photographic paper to provide improved image gloss, a stronger photographic element, less image curl over a wide range of relative humidity, higher image sharpness, and improved image whiteness.

SUMMARY OF THE INVENTION

It is an object of the invention to provide improved photographic papers.

It is another object to provide photosensitive images having improved surface smoothness.

It is a further object to provide a photographic paper with improved curl properties.

It is another object to provide tear resistant photographic paper.

It is a further object to provide a photographic paper with multiple color indicia on the back of photographic images.

It is another object to provide an integral photographic emulsion adhesion layer.

It is further object to provide a lamination bonding layer that resists delamination of the support.

These and other objects of the invention are accomplished by a photographic element comprising at least one photosensitive silver halide layer comprising at least one dye forming coupler, a support comprising paper having laminated thereto a top and bottom sheet comprising biaxially oriented polyolefin sheets, wherein said photographic element has a surface roughness of between 0.15 and 0.50 mm and an average stiffness of between 150 and 300 millinewtons, a stiffness ratio between machine direction and cross direction of between 0.8 and 1.2 at between 20 and 70% humidity, a maximum curl value of 10 curl units, said photographic element has a back roughness of between 0.30 and 2.00 mm, and has a tear strength of between 300 and 900 N.

ADVANTAGEOUS EFFECT OF THE INVENTION

The invention provides an improved base for casting of photosensitive layers. It particularly provides improved base for color photographic materials that have greater resistance to curl, an improved image, tear resistance, and balanced stiffness.

DETAILED DESCRIPTION OF THE INVENTION

The invention has numerous advantages over prior practices in the art. The invention provides a photographic element that has much less tendency to curl when exposed to extremes of humidity. Further, the invention provides a photographic paper that is much lower in cost as the criticalities of the formation of the polyethylene are removed. There is no need for the difficult and expensive casting and cooling in forming a surface on the polyethylene layer, as the biaxially oriented polymer sheet of the invention provides a high quality surface for casting of photosensitive layers. The optical properties of the photographic elements in accordance with the invention are improved, as the color materials may be concentrated at the surface of the biaxially oriented sheet for most effective use with little waste of the colorant materials. Photographic materials utilizing microvoided sheets of the invention have improved resistance to tearing. The photographic materials of the invention are lower in cost to produce, as the microvoided sheet may be scanned for quality prior to assembly into the photographic member. With present polyethylene layers the quality of the layer cannot be assessed until after complete formation of the base paper with the polyethylene waterproofing layer attached. Therefore, any defects result in expensive discard of expensive product. The invention allows faster hardening of photographic paper emulsion, as water vapor is not transmitted from the emulsion through the biaxially oriented sheets.

Another advantage of the microvoided sheets of the invention is that they are more opaque than titanium dioxide loaded polyethylene of present products. They achieve this opacity partly by the use of the voids, as well as the improved concentration of titanium dioxide at the surface of the sheet. The photographic elements of this invention are more scratch resistant as the oriented polymer sheet on the back of the photographic element resists scratching and other damage more readily than polyethylene. The photographic elements of this invention are balanced for stiffness in the machine and cross directions. A balanced stiffness of the photographic element is perceptually preferred over a photographic element that is predominantly stiff in one direction. The photographic elements of this invention utilize a low cost method for printing multiple color branding information of the backside of the image, increasing the content of the information on the backside of the image. The paper base used in the invention is smoother and substantially free of undesirable orange peel which interferes with the viewing of the image.

The photographic elements of this invention utilize an integral emulsion bonding layer that allows the emulsion to adhere to the support materials during manufacturing and wet processing of images. The microvoided sheets of the invention are laminated to the base paper utilizing a bonding layer that prevents delamination of the biaxially oriented sheets from the base paper. These and other advantages will be apparent from the detailed description below.

The terms as used herein, "top", "upper", "emulsion side", and "face" mean the side or toward the side of a photographic member bearing the imaging layers. The terms "bottom", "lower side", and "back" mean the side or toward the side of the photographic member opposite from the side bearing the photosensitive imaging layers or developed image.

The layers of the biaxially oriented polyolefin sheet of this invention have levels of voiding, $TiO_2$, optical brightener, and colorants adjusted to provide optimum optical properties for image sharpness, lightness, and opacity. An important aspect of this invention is the voided polymer layer under the silver halide image layer. The microvoided polymer layer provides an improvement over prior art photographic bases for opacity, sharpness, and lightness without the use of expensive white pigments. The biaxially oriented polyolefin sheet is laminated to a cellulose paper base for stiffness for efficient image processing, as well as consumer product handling. Lamination of high strength biaxially oriented polyolefin sheets to the paper significantly increases the tear resistance of the photographic element compared to present photographic paper. The biaxially oriented sheets are laminated with an ethylene metallocene plastomer that allows for lamination speeds exceeding 500 meters/min and optimizes the bond between the paper base and the biaxially oriented polyolefin sheets.

The cellulose paper base of the invention has a surface that is substantially free of undesirable orange peel roughness which interferes with the viewing of images by the consumer. During lamination it has been found that the biaxially oriented polyolefin sheet replicates the surface of the paper base very well compared to the prior art practice of melt extrusion coating of polyethylene onto the paper base. The orange peel in the paper base is significantly reduced compared to prior art photographic paper bases by rewetting the surface of the paper prior to final calendering, increasing fiber refining, and decreasing the fiber length. The cellulose paper base also has a machine direction to cross direction stiffness ratio of 1.7. This may be compared to prior art photographic paper bases which have a typical ratio of 2.2. The reduction in the machine direction to cross direction ratio, combined with the strength properties of the biaxially oriented sheets, allows for a stiffness balanced photographic element where the stiffness in the machine direction is roughly the same as the stiffness in the cross direction. Present photographic paper machine direction stiffness is typically 200% of the cross direction stiffness. A photographic element with a balanced stiffness is perceptually preferred over present photographic papers.

The biaxially oriented sheets used in the invention contain an integral emulsion bonding layer which avoids the need for expensive priming coatings or energy treatments. The bonding layer used in the invention is a low density polyethylene skin on the biaxially oriented sheet. Gelatin based silver halide emulsion layers of the invention have been shown to adhere well to low density polyethylene. The integral bonding skin layer also serves as a carrier for the blue tints that correct for the native yellowness of the gelatin based silver halide image element. Concentrating the blue tints in the thin, skin layer reduces the amount of expensive blue tint materials when compared to prior art photographic papers that contain blue tint materials dispersed in a single thick layer of polyethylene.

The backside of the photographic element is laminated with a biaxially oriented sheet to reduce humidity image curl. There are particular problems with prior art color papers when they are subjected to extended high humidity storage such as at greater than 50% relative humidity. The high strength biaxially oriented sheet on the backside resists the curling forces, producing a much flatter image. The biaxially oriented sheet on the back has roughness at two frequencies to allow for efficient conveyance through photographic processing equipment and improved consumer writability as consumers add personal information to the backside of photographic paper with pens and pencils. The biaxially oriented sheet also has an energy to break of $4.0\times10^7$ joules per cubic meter to allow for efficient chopping and punching of the photographic element during photographic processing of images.

Because the support materials of the invention are superior to prior art photographic base materials, the support materials of the invention also are superior base materials for digital imaging technology. By coating digital printing ink or dye receiver layers on the top of the support materials of the invention, image quality and image durability can be improved over prior art materials. Examples of suitable digital imaging ink or dye receiver layer technology include ink jet printing receiver layers, thermal dye transfer receiving layers, and electrophotographic receiving layers.

Any suitable biaxially oriented polyolefin sheet may be used for the sheet on the top side of the laminated base of the invention. Microvoided composite biaxially oriented sheets are preferred and are conveniently manufactured by coextrusion of the core and surface layers, followed by biaxial orientation, whereby voids are formed around void-initiating material contained in the core layer. Such composite sheets are disclosed in U.S. Pat. Nos. 4,377,616; 4,758,462; and 4,632,869.

The core of the preferred composite sheet should be from 15 to 95% of the total thickness of the sheet, preferably from 30 to 85% of the total thickness. The nonvoided skin(s) should thus be from 5 to 85% of the sheet, preferably from 15 to 70% of the thickness.

The density (specific gravity) of the composite sheet, expressed in terms of "percent of solid density", is calculated as follows:

$$\frac{\text{Composite Sheet Density}}{\text{Polymer Density}} \times 100 = \%\text{ of Solid Density}$$

Percent solid density should be between 45% and 100%, preferably between 67% and 100%. As the percent solid density becomes less than 67%, the composite sheet becomes less manufacturable due to a drop in tensile strength and it becomes more susceptible to physical damage.

The total thickness of the composite sheet can range from 12 to 100 $\mu$m, preferably from 20 to 70 $\mu$m. Below 20 $\mu$m, the microvoided sheets may not be thick enough to minimize any inherent non-planarity in the support and would be more difficult to manufacture. At thickness higher than 70 $\mu$m, little improvement in either surface smoothness or mechanical properties is seen, and so there is little justification for the further increase in cost for extra materials.

The preferred material is a biaxially oriented polyolefin sheet that is coated with high barrier polyvinylidene chloride in a range of coverage 1.5 to 6.2 g/m$^2$. Polyvinyl alcohol can also be used but is less effective under high relative humidity conditions. Through the use of at least one of these materials in combination with a biaxially oriented sheet and a polymer tie layer, it has been shown that improved rates of emulsion hardening can be achieved. In said photographic or imaging element, the water vapor barrier can be achieved by integrally forming said vapor barrier by coextrusion of the polymer(s) into at least one or more layers and then orienting the sheet by stretching it in the machine direction and then the cross direction. The process of stretching creates a sheet that is more crystalline and has better packing or alignment of the crystalline areas. Higher levels of crystallinity results in lower water vapor transmissions rates which, in turn, results in faster emulsion hardening. The oriented sheet is then laminated to a paper base.

The control of water vapor transmission can be provided by any layer independently such as the tie layer or the biaxially oriented polyolefin sheet or in combination with each other. With the incorporation of other layer(s) that are integrally formed with, applied to, or bonded with the polyolefin sheet, the water vapor transmission rate can be adjusted to achieve the desired photographic or imaging results. One or more of the layers comprising the polyolefin sheet tie layer combinations may contain $TiO_2$ or other inorganic pigment. In addition, one or more of the layers comprising the polyolefin sheet may be voided. Other materials that can be used to enhance the water vapor transmission characteristics comprise at least one material from the group consisting of polyethylene terephthalate, polybutylterephthalate, acetates, cellophane polycarbonates, polyethylene vinyl acetate, ethylene vinyl acetate, methacylate, polyethylene methylacrylate, acrylates, acrylonitrile, polyester ketone, polyethylene acrylic acid, polychlorotrifluoroethylene, polychlorotrifluoroethylene, polytetrafluoroethylene, amorphous nylon, polyhydroxyamide ether, and metal salt of ethylene methacrylic acid copolymers.

An imaging element comprising a paper base, at least one photosensitive silver halide layer, a layer of biaxially oriented polymer sheet between said paper base and said silver halide layer, and at least one polymer layer between said biaxially oriented polymer sheet and said paper base which binds the two together, wherein between the paper and the opaque layers of said biaxially oriented sheet, there is located at least one oxygen barrier layer having less than 2.0 cc/m $^2$.hr.atm (20° C., dry state) oxygen transmission rate is preferred. The terms used herein, "bonding layer", "adhesive layer", and "adhesive" mean the melt extruded resin layer between the biaxially oriented polyolefin sheets and the base paper; "oxygen impermeable layer" and "oxygen barrier layer" refer to the layer having oxygen permeability of not more than 2.0 cc/m$^2$.hr.atm according to the method defined in ASTM D-1434-63 when the layer is measured on its own as a discrete sample.

In one embodiment of this invention it has been shown that when an oxygen barrier of at least 2.0 cc/m$^2$ hr. atm. is provided as an integral part of the biaxially oriented sheet, improved fade performance is achieved after exposure to light fade conditions. In the preferred embodiment of this invention, said barrier layer is ethylene vinyl alcohol and in the most preferred embodiment is polyvinyl alcohol. Additionally it has been shown that the application of an aliphatic polyketone polymer between the emulsion and the photographic paper base forms an oxygen barrier of about 2.0 cc/m$^2$. It is further demonstrated that an imaging element with an integral layer comprising one member selected from the group consisting of homo- and co-polymers of acrylonitrile, alkyl acrylates such as methyl acrylate, ethyl acrylate, and butyl acrylate, alkyl methacrylates such as methyl methacrylate and ethyl methacrylate, methacrilonitrile, alkyl vinyl esters such as vinyl acetate, vinyl proprionate, vinyl ethyl butyrate and vinyl phenyl acetate, alkyl vinyl ethers such as methyl vinyl ether, butyl vinyl ether and chloroethyl vinyl ether, vinyl alcohol, vinyl chloride, vinylidene chloride, vinyl floride, styrene and vinyl acetate (in the case of copolymers, ethylene and/or propylene can be used as comonomers), cellulose acetates such as diacetyl cellulose and triacetyl cellulose, polyesters such as polyethylene terephthalate, a fluorine resin, polyamide (nylon), polycarbonate, polysaccharide, aliphatic polyketone, blue dextran, and cellophane with an oxygen transmission at equal to or less than 2.0 cc/m$^2$ hr. atm. provides improved performance for dye fade. "Void" is used herein to mean devoid of added solid and liquid matter, although it is likely the "voids" contain gas. The void-initiating particles which remain in the finished packaging sheet core should be from 0.1 to 10 $\mu$m in diameter and preferably round in shape to produce voids of the desired shape and size. The size of the void is also dependent on the degree of orientation in the machine and transverse directions. Ideally, the void would assume a shape which is defined by two opposed and edge contacting concave disks. In other words, the voids tend to have a lens-like or biconvex shape. The voids are oriented so that the two major dimensions are aligned with the machine and transverse directions of the sheet. The Z-direction axis is a minor dimension and is roughly the size of the cross diameter of the voiding particle. The voids generally tend to be closed cells, and thus there is virtually no path open from one side of the voided-core to the other side through which gas or liquid can traverse.

The photographic element of this invention generally has a glossy surface, that is, a surface that is sufficiently smooth to provide excellent reflection properties. Prior art photographic paper uses polyethylene cast against a rough chill roll to create nonglossy surfaces. It has been found that by controlling the voiding process in the biaxially oriented sheets, an opalescent surface can be created. An opalescent surface is preferred because it provides a unique photographic appearance to a reflective paper that is perceptually preferred by youth, children, and when utilized as an advertising media. The opalescent surface is achieved when the microvoids in the vertical direction are between 1 and 3 $\mu$m. By the vertical direction, it is meant the direction that is perpendicular to the plane of the imaging member. The thickness of the microvoids preferably is between 0.7 and 1.5 $\mu$m for best physical performance and opalescent properties. The preferred number of microvoids in the vertical direction is between 8 and 30. Less than 6 microvoids in the vertical direction do not create the desired opalescent surface. Greater than 35 microvoids in the vertical direction do not significant improve the optical appearance of the opalescent surface.

The void-initiating material may be selected from a variety of materials and should be present in an amount of about 5 to 50% by weight based on the weight of the core matrix polymer. Preferably, the void-initiating material comprises a polymeric material. When a polymeric material is used, it may be a polymer that can be melt-mixed with the polymer from which the core matrix is made and be able to form dispersed spherical particles as the suspension is cooled down. Examples of this would include nylon dispersed in polypropylene, polybutylene terephthalate in polypropylene, or polypropylene dispersed in polyethylene terephthalate. If the polymer is preshaped and blended into the matrix polymer, the important characteristic is the size and shape of the particles. Spheres are preferred and they can be hollow or solid. These spheres may be made from cross-linked polymers which are members selected from the group consisting of an alkenyl aromatic compound having the general formula Ar—C(R)=$CH_2$, wherein Ar represents an aromatic hydrocarbon radical, or an aromatic halohydrocarbon radical of the benzene series and R is hydrogen or the methyl radical; acrylate-type monomers include monomers of the formula $CH_2$=C(R')—C(O)(OR) wherein R is selected from the group consisting of hydrogen and an alkyl radical containing from about 1 to 12 carbon atoms and R' is selected from the group consisting of hydrogen and methyl; copolymers of vinyl chloride and vinylidene chloride, acrylonitrile and vinyl chloride, vinyl bromide, vinyl esters having formula $CH_2$=CH(O)COR, wherein R is an alkyl radical containing from 2 to 18 carbon atoms; acrylic acid, methacrylic acid, itaconic acid, citraconic acid, maleic acid, fumaric acid, oleic acid, vinylbenzoic acid; the synthetic polyester resins which are prepared by reacting terephthalic acid and dialkyl terephthalics or ester-forming derivatives thereof, with a glycol of the series $HO(CH_2)_nOH$ wherein n is a whole number within the range of 2–10 and having reactive olefinic linkages within the polymer molecule, the above-described polyesters which include copolymerized therein up to 20 percent by weight of a second acid or ester thereof having reactive olefinic unsaturation and mixtures thereof, and a cross-linking agent selected from the group consisting of divinylbenzene, diethylene glycol dimethacrylate, diallyl fumarate, diallyl phthalate, and mixtures thereof.

Examples of typical monomers for making the cross-linked polymer void initiating particles include styrene, butyl acrylate, acrylamide, acrylonitrile, methyl methacrylate, ethylene glycol dimethacrylate, vinyl pyridine, vinyl acetate, methyl acrylate, vinylbenzyl chloride, vinylidene chloride, acrylic acid, divinylbenzene, acrylamidomethyl-propane sulfonic acid, vinyl toluene, etc. Preferably, the cross-linked polymer is polystyrene or poly (methyl methacrylate). Most preferably, it is polystyrene, and the cross-linking agent is divinylbenzene.

Processes well known in the art yield nonuniformly sized void initiating particles, characterized by broad particle size distributions. The resulting beads can be classified by screening the beads spanning the range of the original distribution of sizes. Other processes such as suspension polymerization, limited coalescence, directly yield very uniformly sized particles.

The void-initiating materials may be coated with agents to facilitate voiding. Suitable agents or lubricants include colloidal silica, colloidal alumina, and metal oxides such as tin oxide and aluminum oxide. The preferred agents are colloidal silica and alumina, most preferably, silica. The cross-linked polymer having a coating of an agent may be prepared by procedures well known in the art. For example, conventional suspension polymerization processes wherein the agent is added to the suspension is preferred. As the agent, colloidal silica is preferred.

The void-initiating particles can also be inorganic spheres, including solid or hollow glass spheres, metal or ceramic beads or inorganic particles such as clay, talc, barium sulfate, or calcium carbonate. The important thing is that the material does not chemically react with the core matrix polymer to cause one or more of the following problems: (a) alteration of the crystallization kinetics of the matrix polymer, making it difficult to orient, (b) destruction of the core matrix polymer, (c) destruction of the void-initiating particles, (d) adhesion of the void-initiating particles to the matrix polymer, or (e) generation of undesirable reaction products, such as toxic or high color moieties. The void-initiating material should not be photographically active or degrade the performance of the photographic element in which the biaxially oriented polyolefin sheet is utilized.

For the biaxially oriented sheet on the top side toward the emulsion, suitable classes of thermoplastic polymers for the biaxially oriented sheet and the core matrix-polymer of the preferred composite sheet comprise polyolefins.

Suitable polyolefins include polypropylene, polyethylene, polymethylpentene, polystyrene, polybutylene, and mixtures thereof. Polyolefin copolymers, including copolymers of propylene and ethylene such as hexene, butene, and octene are also useful. Polypropylene is preferred, as it is low in cost and has desirable strength properties.

The nonvoided skin layers of the composite sheet can be made of the same polymeric materials as listed above for the core matrix. The composite sheet can be made with skin(s) of the same polymeric material as the core matrix, or it can be made with skin(s) of different polymeric composition than the core matrix. For compatibility, an auxiliary layer can be used to promote adhesion of the skin layer to the core.

The total thickness of the top most skin layer should be between 0.20 $\mu$m and 1.5 $\mu$m, preferably between 0.5 and 1.0 $\mu$m. Below 0.5 $\mu$m any inherent nonplanarity in the coextruded skin layer may result in unacceptable color variation. At skin thickness greater than 1.0 $\mu$m, there is a reduction in the photographic optical properties such as image resolution. At thickness greater than 1.0 $\mu$m, there is also a greater material volume to filter for contamination such as clumps or poor color pigment dispersion.

Addenda may be added to the topmost skin layer to change the color of the imaging element. For photographic use, a white base with a slight bluish tinge is preferred. The addition of the slight bluish tinge may be accomplished by any process which is known in the art including the machine blending of color concentrate prior to extrusion and the melt extrusion of blue colorants that have been preblended at the desired blend ratio. Colored pigments that can resist extrusion temperatures greater than 320° C. are preferred, as temperatures greater than 320° C. are necessary for coextrusion of the skin layer. Blue colorants used in this invention may be any colorant that does not have an adverse impact on the imaging element. Preferred blue colorants include Phthalocyanine blue pigments, Cromophtal blue pigments, Irgazin blue pigments, and Irgalite organic blue pigments. Optical brightener may also be added to the skin layer to absorb UV energy and emit light largely in the blue region. $TiO_2$ may also be added to the skin layer. While the addition of $TiO_2$ in the thin skin layer of this invention does not significantly contribute to the optical performance of the sheet, it can cause numerous manufacturing problems such as extrusion die lines and spots. The skin layer substantially free of $TiO_2$ is preferred. $TiO_2$ added to a layer between 0.20 and 1.5 $\mu$m does not substantially improve the optical properties of the support, will add cost to the design, and will cause objectionable pigments lines in the extrusion process.

Addenda may be added to the core matrix and/or to one or more skin layers to improve the optical properties of the photographic support. Titanium dioxide is preferred and is used in this invention to improve image sharpness or MTF, opacity, and whiteness. The $TiO_2$ used may be either anatase or rutile type. Further, both anatase and rutile $TiO_2$ may be blended to improve both whiteness and sharpness. Examples of $TiO_2$ that are acceptable for a photographic system are DuPont Chemical Co. R101 rutile $TiO_2$ and DuPont Chemical Co. R104 rutile $TiO_2$. Other pigments known in the art to improve photographic optical responses may also be used in this invention. Examples of other pigments known in the art to improve whiteness are talc, kaolin, $CaCO_3$, $BaSO_4$, ZnO, $TiO_2$, ZnS, and $MgCO_3$. The preferred $TiO_2$ type is anatase, as anatase $TiO_2$ has been found to optimize image whiteness and sharpness with a voided layer.

The preferred weight percent of white pigment to be added to the biaxially oriented layers between the photosensitive layer and the voided layer can range from 18% to 24%. Below 15% the optical properties of the voided biaxially oriented sheet do not show a significant improvement over prior art photographic paper. Above 28%, manufacturing problems such as unwanted voiding and a loss of coating speed are encountered. The voided layer may also contain white pigments. The voided layer may contain between 2 and 18% white pigment, preferably between 2% and 8%. Below 2%, the optical properties of the voided biaxially oriented sheet do not show a significant improvement. Above 8%, the voided layer suffers from a loss in mechanical strength which will reduce the commercial value of the photographic support of this invention as images are handled and viewed by consumers.

The layer adjacent and below the voided layer may also contain white pigments of this invention. A layer that is substantially colorant free is preferred, as there is little improvement in the optical performance of the photographic support when colorants are added below the voided layer. The preferred weight percent of white pigment to be added to the biaxially oriented layer below the voided layer can range from 12% to 24%. Below 8% the optical properties of the voided biaxially oriented sheet do not show a significant improvement over prior art photographic paper. Above 28%, manufacturing problems such as unwanted voiding, loss of coating speed, and poor $TiO_2$ dispersions are encountered.

Addenda may be added to the biaxially oriented sheet of this invention so that when the biaxially oriented sheet is viewed from a surface, the imaging element emits light in the visible spectrum when exposed to ultraviolet radiation. Emission of light in the visible spectrum allows for the support to have a desired background color in the presence of ultraviolet energy. This is particularly useful when images are viewed outside as sunlight contains ultraviolet energy and may be used to optimize image quality for consumer and commercial applications.

Addenda known in the art to emit visible light in the blue spectrum are preferred. Consumers generally prefer a slight blue tint to the density minimum areas of a developed image defined as a negative b* compared to a neutral density minimum defined as a b* within one b* unit of zero. b* is the measure of yellow/blue in CIE (Commission Internationale de L'Eclairage) space. A positive b* indicates yellow, while a negative b* indicates blue. The addition of addenda that emits in the blue spectrum allows for tinting the support without the addition of colorants which would decrease the whiteness of the image. The preferred emission is between 1 and 5 delta b* units. Delta b* is defined as the b* difference measured when a sample is illuminated with a ultraviolet light source and a light source without any significant ultraviolet energy. Delta b* is the preferred measure to determine the net effect of adding an optical brightener to the top biaxially oriented sheet of this invention. Emissions less than 1 b* unit cannot be noticed by most customers; therefore, is it not cost effective to add optical brightener to the biaxially oriented sheet when the b* is changed by less than 1 b* unit. An emission greater that 5 b* units would interfere with the color balance of the images making the whites appear too blue for most consumers.

The preferred addenda of this invention is an optical brightener. An optical brightener is a colorless, fluorescent, organic compound that absorbs ultraviolet light and emits it as visible blue light. Examples include, but are not limited to, derivatives of 4,4'-diaminostilbene-2,2'-disulfonic acid, coumarin derivatives such as 4-methyl-7-diethylaminocoumarin, 1-4-Bis(O-Cyanostyryl)Benzol and 2-Amino-4-Methyl Phenol.

Layers below the exposed surface layer in biaxially oriented sheet of the invention may also contain pigments which are known to improve the photographic optical responses such as whiteness or sharpness. Titanium dioxide is used in this invention to improve image sharpness, whiteness, and provide the required level of opacity to the biaxially oriented sheets. The $TiO_2$ used may be either anatase or rutile type. For this invention, rutile is the preferred because the unique particle size and geometry optimize image quality for most consumer applications. Examples of rutile $TiO_2$ that are acceptable for a photographic system are DuPont Chemical Co. R101 rutile $TiO_2$ and DuPont Chemical Co. R104 rutile $TiO_2$. Other pigments to improve image quality may also be used in this invention.

The present invention in a preferred embodiment consists of a multilayer film of biaxially oriented polyolefin which is attached to both the top and bottom of a photographic quality paper support by melt extrusion of a polymer tie layer. The biaxially oriented films that have been used in this invention contain a plurality of layers in which at least one of the layers contains voids. The voids provide added opacity to the imaging element. This voided layer can also be used in conjunction with a layer that contains at least one pigment from the group consisting of $TiO_2$, $CaCO_3$, clay, $BaSO_4$, ZnS, $MgCO_3$, talc, kaolin, or other materials that provide a highly reflective white layer in said film of more than one layer. The combination of a pigmented layer with a voided layer provides advantages in the optical performance of the final image.

Voided layers are more susceptible than solid layers to mechanical failure, such as cracking or delamination from adjacent layers. Voided structures that contain $TiO_2$, or are in proximity to layers containing $TiO_2$, are particularly susceptible to loss of mechanical properties and mechanical failure with long-term exposure to light. $TiO_2$ particles initiate and accelerate the photooxidative degradation of polypropylene. The addition of a hindered amine stabilizer to at least one layer of a multilayer biaxially oriented film and in the preferred embodiment in the layers containing $TiO_2$ and, furthermore, in the most preferred embodiment the hindered amine is in the layer with $TiO_2$, as well as in the adjacent layers, that improvements to both light and dark keeping image stability are achieved.

The film preferably contains a stabilizing amount of hindered amine at or about 0.01 to 5% by weight in at least one layer of said film. While these levels provide improved stability to the biaxially oriented film, the preferred amount at or about 0.1 to 3% by weight provides an excellent balance between improved stability for both light and dark keeping, while making the structure more cost effective.

The hindered amine light stabilizer (HALS) may come from the common group of hindered amine compounds originating from 2,2,6,6-tetramethylpiperidine, and the term hindered amine light stabilizer is accepted to be used for hindered piperidine analogs. The compounds form stable nitroxyl radicals that interfere with photooxidation of polypropylene in the presence of oxygen, thereby affording excellent long-term photographic stability of the imaging element. The hindered amine will have sufficient molar mass to minimize migration in the final product, will be miscible with polypropylene at the preferred concentrations, and will not impart color to the final product. In the preferred embodiment, examples of HALS include poly{[6-[(1,1,3,3-tetramethylbutylamino}-1,3,5-triazine-4-piperidinyl)-imino]-1,6-hexanediyl[(2,2,6,6-tetramethyl-4-piperdinyl) imino]} (Chimassorb 944 LD/FL), Chimassorb 119, and bis(1,2,2,6,6-pentamethyl-4-piperidinyl)[3,5-bis(1,1-dimethylethyl-4-hydroxyphenyl)methyl]butylpropanedioate (Tinuvin 144), although they are not limited to these compounds.

In addition, the film may contain any of the hindered phenol primary antioxidants commonly used for thermal stabilization of polypropylene, alone, or in combination with a secondary antioxidants. Examples of hindered phenol primary antioxidants include pentaerythrityl tetrakis [3-(3,5-di-tert-butyl-4-hydroxyphenyl)proprionate] (such as Irganox 1010), octadecyl 3-(3,5-di-tert-butyl-4-hydroxyphenyl) proprionate (such as Irganox 1076), benzenepropanoic acid 3,5-bis(1,1-dimethyl)-4-hydroxy-2[3-[3,5-bis(1,1-dimethylethyl)-4-hydroxyphenyl)-1-oxopropyl)hydrazide (such as Irganox MD1024), 2,2'-thiodiethylenebis[3-(3,5-di-tert-butyl-4-hydroxyphenyl)proprionate] (such as Irganox 1035), 1,3,5-trimethyl-2,4,6-tri(3,5-di-tert-butyl-4-hydroxybenzyl)benzene (such as Irganox 1330), but are not limited to these examples. Secondary antioxidants include organic alkyl and aryl phosphites including examples such as triphenylphosphite (such as Irgastab TPP), tri(n-propylphenyl-phophite) (such as Irgastab SN-55), 2,4-bis(1,1-dimethylphenyl)phosphite (such as Irgafos 168), and in a preferred embodiment would include Irgafos 168. The combination of hindered amines with other primary and secondary antioxidants have a synergistic benefit in a multilayer biaxially oriented polymer sheet by providing thermal stability to polymers such as polypropylene during melt processing and extrusion, and further enhancing their light and dark keeping properties which is not evident in a mono layer system for imaging products such as photographs. These unexpected results provide for a broader range of polymers that can be utilized in imaging product, thus enabling enhanced features to be incorporated into their design.

Traditional photographic supports that contain optical brightener generally use anatase $TiO_2$ in combination optical brightener. The use of rutile $TiO_2$, while preferred for image quality, tends to reduce the efficiency of the optical brightener when optical brightener and rutile $TiO_2$ are used in combination. Prior art photographic supports containing optical brightener generally use anatase $TiO_2$ in combination with optical brightener. By concentrating the optical brightener and rutile $TiO_2$ in one functional thin layer, rutile $TiO_2$ does not significantly reduce the efficiency of the optical brightener, allowing for rutile $TiO_2$ and optical brightener to be used together which improve image quality. The preferred location for the $TiO_2$ is adjacent to the exposed layer. This location allows for efficient manufacture of the biaxially oriented coextruded structure, as the $TiO_2$ does not come in contact with exposed extrusion die surfaces.

The optical brightener may be added to any layer in the multilayer coextruded biaxially oriented polyolefin sheet. The preferred location is adjacent to or in the exposed surface layer of said sheet. This allows for the efficient concentration of optical brightener which results in less optical brightener being used when compared to traditional photographic supports. Typically 20% to 40% less optical brightener is required when the optical brightener is concentrated in a functional layer close to the imaging layers.

When the desired weight percentage loading of the optical brightener begins to approach a concentration at which the optical brightener migrates to the surface of the support forming crystals in the imaging layer, the addition of optical brightener into the layer adjacent to the exposed layer is preferred. In prior art imaging supports that use optical brightener, expensive grades of optical brightener are used to prevent migration into the imaging layer. When optical brightener migration is a concern, as with light sensitive silver halide imaging systems, the preferred exposed layer comprises polyethylene that is substantially free of optical brightener. In this case, the migration from the layer adjacent to the exposed layer is significantly reduced because the exposed surface layer acts as a barrier for optical brightener migration allowing for much higher optical brightener levels to be used to optimize image quality. Further, locating the optical brightener in the layer adjacent to the exposed layer allows for a less expensive optical brightener to be used as the exposed layer, which is substantially free of optical brightener, prevents significant migration of the optical brightener. Another preferred method to reduce unwanted optical brightener migration in biaxially oriented sheets of this invention is to use polypropylene for the layer adjacent to the exposed surface. Prior art photographic supports generally use melt extruded polyethylene to provide waterproofing to the base paper. Since optical brightener is more soluble in polypropylene than polyethylene, the optical brightener is less likely to migrate from polypropylene to the exposed surface layer.

A biaxially oriented sheet of this invention which has a microvoided core is preferred. The microvoided core adds opacity and whiteness to the imaging support, further improving imaging quality. Combining the image quality advantages of a microvoided core with a material, which absorbs ultraviolet energy and emits light in the visible spectrum, allows for the unique optimization of image quality, as the image support can have a tint when exposed to ultraviolet energy yet retain excellent whiteness when the image is viewed using lighting that does not contain significant amounts of ultraviolet energy such as indoor lighting.

It has been found that the microvoids located in the voided layer of the top biaxially oriented sheet provide a reduction in undesirable pressure fog. Mechanical pressure, of the order of hundreds of kilograms per square centimeter, causes an undesirable, reversible decrease in sensitivity by a mechanism at the time of writing that is not fully understood. The net result of mechanical pressure is an unwanted increase in density, mainly yellow density. The voided layer in the biaxially oriented sheet absorbs mechanical pressure by compression of the voided layer, common in the converting and photographic processing steps, and reduces the amount of yellow density change. Pressure sensitivity is measured by applying a 206 MPa load to the coated light sensitive silver halide emulsion, developing the yellow layer, and measuring the density difference with an X-Rite model 310 (or comparable) photographic transmission densitometer between the control sample which was unloaded and the loaded sample. The preferred change in yellow layer density is less than 0.02 at a pressure of 206 MPa. A 0.04 change in yellow density is perceptually significant and, thus, undesirable.

The coextrusion, quenching, orienting, and heat setting of these composite sheets may be effected by any process which is known in the art for producing oriented sheet, such as by a flat sheet process or a bubble or tubular process. The flat sheet process involves extruding the blend through a slit die and rapidly quenching the extruded web upon a chilled casting drum so that the core matrix polymer component of the sheet and the skin components(s) are quenched below their glass solidification temperature. The quenched sheet is then biaxially oriented by stretching in mutually perpendicular directions at a temperature above the glass transition temperature and below the melting temperature of the matrix polymers. The sheet may be stretched in one direction and then in a second direction or may be simultaneously stretched in both directions. After the sheet has been stretched, it is heat set by heating to a temperature sufficient to crystallize or anneal the polymers, while restraining to some degree the sheet against retraction in both directions of stretching.

The composite sheet, while described as having preferably at least three layers of a microvoided core and a skin layer on each side, may also be provided with additional layers that may serve to change the properties of the biaxially oriented sheet. A different effect may be achieved by additional layers. Such layers might contain tints, antistatic materials, or different void-making materials to produce sheets of unique properties. Biaxially oriented sheets could be formed with surface layers that would provide an improved adhesion, or look to the support and photographic element. The biaxially oriented extrusion could be carried out with as many as 10 layers if desired to achieve some particular desired property.

These composite sheets may be coated or treated after the coextrusion and orienting process or between casting and full orientation with any number of coatings which may be used to improve the properties of the sheets including printability, to provide a vapor barrier, to make them heat sealable, or to improve the adhesion to the support or to the photosensitive layers. Examples of this would be acrylic coatings for printability and coating polyvinylidene chloride for heat seal properties. Further examples include flame, plasma, or corona discharge treatment to improve printability or adhesion.

By having at least one nonvoided skin on the microvoided core, the tensile strength of the sheet is increased and makes the sheet more manufacturable. The higher tensile strength also allows the sheets to be made at wider widths and higher draw ratios than when sheets are made with all layers voided. Coextruding the layers further simplifies the manufacturing process.

The structure of a preferred top biaxially oriented sheet of the invention where the exposed surface layer is adjacent to the imaging layer is as follows:

| |
|---|
| Polyethylene exposed surface layer with blue tint |
| Polypropylene layer containing 24% anatase $TiO_2$, optical brightener and HALS |
| Polypropylene microvoided layer with 0.55 grams per cubic cm density |
| Polypropylene layer with 18% anatase $TiO_2$ and HALS |
| Polypropylene bottom layer |

The sheet on the side of the base paper opposite to the emulsion layers or backside sheet may be any suitable sheet having the surface roughness used in this invention. The sheet may or may not be microvoided. Biaxially oriented sheets are conveniently manufactured by coextrusion of the sheet, which may contain several layers, followed by biaxial orientation. Such biaxially oriented sheets are disclosed in, for example, U.S. Pat. No. 4,764,425.

The preferred backside biaxially oriented sheet is a biaxially oriented polyolefin sheet, most preferably a sheet of polyethylene or polypropylene. The thickness of the biaxially oriented sheet should be from 10 to 150 $\mu$m. Below 15 $\mu$m, the sheets may not be thick enough to minimize any inherent nonplanarity in the support and would be more difficult to manufacture. At thickness higher than 70 $\mu$m, little improvement in either surface smoothness or mechanical properties is seen, and so there is little justification for the further increase in cost for extra materials.

Suitable classes of thermoplastic polymers for the backside biaxially oriented sheet core and skin layers include polyolefins, polyesters, polyamides, polycarbonates, cellulosic esters, polystyrene, polyvinyl resins, polysulfonamides, polyethers, polyimides, polyvinylidene fluoride, polyurethanes, polyphenylenesulfides, polytetrafluoroethylene, polyacetals, polysulfonates, polyester ionomers, and polyolefin ionomers. Copolymers and/or mixtures of these polymers can be used.

Suitable polyolefins for the core and skin layers of the backside sheet include polypropylene, polyethylene, polymethylpentene, and mixtures thereof. Polyolefin copolymers, including copolymers of propylene and ethylene such as hexene, butene, and octene are also useful. Polypropylenes are preferred because they are low in cost and have good strength and surface properties.

Suitable polyesters include those produced from aromatic, aliphatic or cycloaliphatic dicarboxylic acids of 4–20 carbon atoms and aliphatic or alicyclic glycols having from 2–24 carbon atoms. Examples of suitable dicarboxylic acids include terephthalic, isophthalic, phthalic, naphthalene dicarboxylic acid, succinic, glutaric, adipic, azelaic, sebacic, fumaric, maleic, itaconic, 1,4-cyclohexanedicarboxylic, sodiosulfoisophthalic, and mixtures thereof. Examples of suitable glycols include ethylene glycol, propylene glycol, butanediol, pentanediol, hexanediol, 1,4-cyclohexanedimethanol, diethylene glycol, other polyethylene glycols, and mixtures thereof. Such polyesters are well known in the art and may be produced by well-known techniques, e.g., those described in U.S. Pat. No. 2,465,319 and U.S. Pat. No. 2,901,466. Preferred continuous matrix polyesters are those having repeat units from terephthalic acid or naphthalene dicarboxylic acid and at least one glycol selected from ethylene glycol, 1,4-butanediol and 1,4-cyclohexanedimethanol. Poly(ethylene terephthalate), which may be modified by small amounts of other monomers, is especially preferred. Other suitable polyesters include liquid crystal copolyesters formed by the inclusion of suitable amount of a co-acid component such as stilbene dicarboxylic acid. Examples of such liquid crystal copolyesters are those disclosed in U.S. Pat. Nos. 4,420,607; 4,459,402; and 4,468,510.

Useful polyamides include nylon 6, nylon 66, and mixtures thereof. Copolymers of polyamides are also suitable continuous phase polymers. An example of a useful polycarbonate is bisphenol-A polycarbonate. Cellulosic esters suitable for use as the continuous phase polymer of the composite sheets include cellulose nitrate, cellulose triacetate, cellulose diacetate, cellulose acetate propionate, cellulose acetate butyrate, and mixtures or copolymers thereof. Useful polyvinyl resins include polyvinyl chloride, poly(vinyl acetal), and mixtures thereof. Copolymers of vinyl resins can also be utilized.

The biaxially oriented sheet on the backside of the laminated base can be made with one or more layers of the same polymeric material, or it can be made with layers of different polymeric composition. For compatibility, an auxiliary coextruded layer can be used to promote adhesion of multiple layers.

The coextrusion, quenching, orienting, and heat setting of the bottom biaxially oriented sheets may be effected by any process which is known in the art for producing oriented sheet, such as by a flat sheet process or a bubble or tubular process. The flat sheet process involves extruding or coextruding the blend through a slit die and rapidly quenching the extruded or coextruded web upon a chilled casting drum so that the polymer component(s) of the sheet are quenched below their solidification temperature. The quenched sheet is then biaxially oriented by stretching in mutually perpendicular directions at a temperature above the glass transition temperature of the polymer(s). The sheet may be stretched in one direction and then in a second direction or may be simultaneously stretched in both directions. After the sheet has been stretched, it is heat set by heating to a temperature sufficient to crystallize the polymers while restraining to some degree the sheet against retraction in both directions of stretching.

The quenched bottom sheet is then biaxially oriented by stretching in mutually perpendicular directions at a temperature above the glass transition temperature of the polymer(s). The sheet may be stretched in one direction and then in a second direction or may be simultaneously stretched in both directions. After the sheet has been stretched, it is heat set by heating to a temperature sufficient to crystallize the polymers, while restraining to some degree the sheet against retraction in both directions of stretching. A typical biaxial orientation ratio for the machine direction to cross direction is 5:8. A 5:8 orientation ratio develops the mechanical properties of the biaxially oriented sheet in both the machine and cross directions. By altering the orientation ratio, the mechanical properties of the biaxially oriented sheet can be developed in just one direction or both directions. An orientation ratio that yields the desired mechanical properties of this invention is 2:8.

In the photofinishing process it is necessary that the photofinishing equipment chops rolls of photographic paper into the final image format. Generally, the photofinishing equipment is only required to make chops in the cross machine direction, as the manufacturer of the imaging element has previously cut to a width that is suitable for the photofinishing machine being utilized. It is necessary that these chops in the cross direction be accurate and cleanly made. Inaccurate cuts lead to fiber projections hanging from the prints which is undesirable. The undesirable fiber projections are primarily torn backside polymer sheet and not cellulose paper fiber. Further, poor cross machine direction cutting can lead to edge damage on the final image. With imaging elements containing biaxially oriented sheets in the base, the standard photofinishing machine cutters have difficulty in producing edges free of fibrous projections. Therefore, there is a need which is solved by this invention to provide a biaxially oriented sheet containing a photographic element that may be cut in the cross direction by conventional cutters.

In the photofinishing process it is necessary that the photofinishing machines punch index holes into the imaging element as it moves through the machine. An accurate or incomplete punching of these holes will lead to undesirable results, as the machine will not image the prints in the proper place. Further, failure to properly make index punches may lead to jamming, as prints may be cut to a size which the machine cannot handle. Since punching in photographic processing equipment usually occurs from the emulsion side, the fracture mechanism of bottom of the photographic element is a combination of cracks originating from both the punch and die. With tight clearances, as in a punch and die set with less than 1,000,000 actuations, the cracks, originating from the tool edges, miss each other and the cut is completed by a secondary tearing process producing a jagged edge approximately midway in bottom sheet thickness that is a function of punch and die clearance. As the punch and die begin to wear from repeated actuations, excessive clearance is formed allowing for extensive plastic deformation of the bottom sheet. When the crack finally forms, it can miss the opposing crack, separation is delayed and a long polymer burr can form in the punched hole. This long burr can cause unacceptable punched holes which can result in machine jams. For punching of the bottom biaxially oriented sheet of this invention, the energy to break is a significant factor in determining the quality of the punched index hole. Lowering the energy to break the bottom sheet for punching allows for punching fracture to occur at lower punch forces and aids in the reduction of punch burrs in the punched hole. The energy to break for the bottom polymer sheets of this invention is defined as the area under the stress strain curve. Energy to break is measured by running a simple tensile strength test for polymer sheets at a rate of 4000% strain per min.

For imaging materials that are chopped or for imaging materials that are punched with an index hole, energy to break of less than $3.5\times10^7$ J/m$^3$ for the bottom biaxially oriented sheet in at least one direction is preferred. A biaxially oriented polymer sheet with a energy to break greater than $4.0\times10^7$ J/m$^3$ does not show significant improvement in chopping or punching. For photographic paper that is chopped in photofinishing equipment, an energy to break of less than $3.5\times10^7$ J/m$^3$ in machine direction is preferred since the chopping usually occurs in the cross direction.

For imaging elements of this invention, the most preferred energy to break is between $9.0\times10^5$ J/m$^3$ and $3.5\times10^7$ J/m$^3$. Bottom polymer sheets with an energy to break less than $5.0\times10^5$ J/m$^3$ are expensive in that the process yield for oriented bottom sheets are reduced as lower orientation ratios are used to lower the energy to break. An energy to break greater than $4.0\times10^7$ J/m$^3$ does not show significant improvement for punching and chopping over cast low density polyethylene sheets that are commonly used as backside sheets in prior art imaging supports.

The preferred thickness of the biaxially oriented sheet should be from 12 to 50 $\mu$m. Below 12 $\mu$m, the sheets may not be thick enough to minimize any inherent nonplanarity in the support, would be more difficult to manufacture, and would not provide enough strength to provide curl resistance to a gel containing imaging layer such as a light sensitive silver halide emulsion. At thickness higher than 50 $\mu$m, little improvement in mechanical properties are seen, and so there is little justification for the further increase in cost for extra materials. Also at thickness greater than 50 $\mu$m, the force to punch an index hole in the photofinishing equipment is beyond the design force of some photofinishing equipment. Failure to complete a punch will result in machine jamming and loss of photofinishing efficiency.

The surface roughness of the backside sheet of this invention has two necessary surface roughness components to provide both efficient transport in photoprocessing equipment and writability and photoprocessing back marking. A combination of both low frequency roughness to provide efficient transport and high frequency roughness to provide a surface for printing and writing is preferred. High frequency surface roughness defined as having a spatial frequency greater than 500 cycles/mm with a median peak to valley height less than 1 $\mu$m. High frequency roughness is a determining factor in photofinishing back marking where valuable information is printed on the backside of an image and consumer backside writability where a variety of writing instruments such as pens and pencils are used to mark the backside of an image. High frequency roughness is measured using a Park Scientific M-5 Atomic Force multimodal scanning probe microscope. Data collection was accomplished by frequency modulation intermittent contact scanning microscopy in topography mode. The tip was an ultralevel 4:1 aspect ratio with an approximate radius of 100 Angstroms.

Low frequency surface roughness of backside biaxially oriented film or Ra is a measure of relatively finely spaced surface irregularities such as those produced on the backside of prior art photographic materials by the casting of polyethylene against a rough chilled roll. The low frequency surface roughness measurement is a measure of the maximum allowable roughness height expressed in units of micrometers and by use of the symbol Ra. For the irregular profile of the backside of photographic materials of this invention, the average peak to valley height, which is the average of the vertical distances between the elevation of the highest peak and that of the lowest valley, is used. Low frequency surface roughness, that is surface roughness that has spatial frequency between 200 and 500 cycles/mm with a median peak to valley height greater than 1 $\mu$m. Low frequency roughness is the determining factor in how efficiently the imaging element is transported through photofinishing equipment, digital printers, and manufacturing processes. Low frequency roughness is commonly measured by surface measurement device such as a Perthometer.

Biaxially oriented polyolefin sheets commonly used in the packaging industry are commonly melt extruded and then oriented in both directions (machine direction and cross direction) to give the sheet desired mechanical strength properties. The process of biaxial orientation generally creates a low frequency surface roughness of less than 0.23 $\mu$m. While the smooth surface has value in the packaging industry, use as a backside layer for photographic paper is limited. The preferred low frequency roughness for biaxially oriented sheets of this invention is between 0.30 and 2.00 μm. Laminated to the backside of the base paper, the biaxially oriented sheet must have a low frequency surface roughness greater than 0.30 μm to ensure efficient transport through the many types of photofinishing equipment that have been purchased and installed around the world. At a low frequency surface roughness less that 0.30 μm, transport through the photofinishing equipment becomes less efficient. At low frequency surface roughness greater than 2.54 μm, the surface would become too rough causing transport problems in photofinishing equipment, and the rough backside surface would also begin to emboss the silver halide emulsion as the material is wound in rolls.

The structure of a preferred backside biaxially oriented sheet of this invention wherein the skin layer is on the bottom of the photographic element is as follows:

| |
|---|
| Solid polypropylene core |
| Copolymer of polyethylene and a terpolymer of ethylene, propylene and butylene |
| Styrene butadiene methacrylate coating |

The low frequency surface roughness of the skin layer can be accomplished by introducing addenda into the bottom most layer. The particle size of the addenda is preferably between 0.20 μm and 10 μm. At particles sizes less than 0.20 μm, the desired low frequency surface roughness cannot be obtained. At particles sizes greater than 10 μm, the addenda begins to create unwanted surface voids during the biaxially orientation process that would be unacceptable in a photographic paper application and would begin to emboss the silver halide emulsion as the material is wound in rolls. The preferred addenda to be added to the bottommost skin layer, to create the desired backside roughness, comprise a material selected from the group of inorganic particulates consisting of titanium dioxide, silica, calcium carbonate, barium sulfate, alumina, kaolin, and mixtures thereof. The addenda may also be cross-linked polymers beads using monomers from the group consisting of styrene, butyl acrylate, acrylamide, acrylonitrile, methyl methacrylate, ethylene glycol dimethacrylate, vinyl pyridine, vinyl acetate, methyl acrylate, vinylbenzyl chloride, vinylidene chloride, acrylic acid, divinylbenzene, acrylamidomethyl-propane sulfonic acid, vinyl toluene, polystyrene, or poly(methyl methacrylate).

Addenda may also be added to the biaxially oriented backside sheet to improve the whiteness of these sheets. This would include any process which is known in the art including adding a white pigment, such as titanium dioxide, barium sulfate, clay, or calcium carbonate. This would also include adding. fluorescing agents which absorb energy in the UV region and emit light largely in the blue region, or other additives which would improve the physical properties of the sheet or the manufacturability of the sheet.

The most preferred method of creating the desired low frequency roughness on the bottommost skin layer of a biaxially oriented sheet is the use of incompatible block copolymers mixed with a matrix polymer such as polypropylene. Block copolymers of this invention are polymers containing long stretches of two or more monomeric units linked together by chemical valences in one single chain. During the biaxially orientation of the sheet, the incompatible block copolymers do not mix with each other or the matrix polymer and, as a result, a bumpy, rough surface is created. During orientation of the biaxially oriented sheet of this invention when the skin layer is oriented above the glass transition temperature of the matrix polymer, the incompatible block copolymers flow at different rates and create desired low frequency surface roughness and a lower surface gloss when compared to a typical biaxially oriented sheet containing homopolymers in the skin layer (which flow at the same rate and thus create a uniform smooth surface). The preferred block copolymers of this invention are mixtures of polyethylene and polypropylene. An example of a polymer formulation that provides the low frequency surface roughness of this invention is a copolymer of polyethylene and a terpolymer comprising ethylene, propylene, and butylene.

The final preferred method for increasing the low frequency surface roughness of smooth biaxially oriented sheets is embossing roughness into the sheet by use of a commercially available embossing equipment. Smooth films are transported through a nip that contains a nip roll and an impression roll. The impression roll under pressure and heat embosses the roll pattern onto the biaxially oriented smooth sheets. The surface roughness and pattern obtained during embossing is the result of the surface roughness and pattern on the embossing roll.

A random low frequency roughness pattern is preferred on the bottommost layer of the biaxially oriented sheet. A random pattern, or one that has no particular pattern, is preferred to an ordered pattern because the random pattern best simulates the appearance and texture of cellulose paper which adds to the commercial value of a photographic image. A random pattern on the bottommost skin layer will reduce the impact of the low frequency surface roughness transferring to the image side when compared to an ordered pattern. A transferred low frequency surface roughness pattern that is random is more difficult to detect than an ordered pattern.

The preferred high frequency roughness of biaxially oriented sheets of this invention is between 0.001 and 0.05 μm when measured with a high pass cutoff filter of 500 cycles/mm. High frequency roughness less than 0.0009 μm does not provide the required roughness for photofinishing back mark retention through wet chemistry processing of images. The high frequency roughness provides a nonuniform surface upon which the ink from the back mark, usually applied by a contact printer or ink jet printer, can adhere and be protected from the abrasion of photoprocessing. High frequency roughness greater than 0.060 μm does not provide the proper roughness for improved consumer writability with pens and pencils. Pens, much like the photoprocessing back mark, need a site for the pen ink to collect and dry. Pencils need a roughness to abrade the carbon from the pencil.

High frequency surface roughness of the backside sheet of this invention is accomplished by coating a separate layer on the skin which contains material that will produce the desired frequency of surface roughness, or by some combination of the two methods. Materials that will provide the desired high frequency of roughness include silicon dioxide, aluminum oxide, calcium carbonate, mica, kaolin, alumina, barium sulfate, titanium dioxide, and mixtures thereof. In addition, cross-linked polymer beads using styrene, butyl acrylamide, acrylonitrile, methyl methacrylate, ethylene glycol dimethacrylate, vinyl pyridine, vinyl acetate, methyl acrylate, vinyl benzyl chloride, vinylidene chloride, acrylic acid, divinyl benzene, acrylamido methyl-propane, and polysiloxane resin may be used to form high frequency surface roughness of this invention. All these stated materials may be used in the skin layer, or as a coated layer, or in some combination thereof.

The preferred method by which the desired high frequency roughness may be created is through the application of a coated binder. The coated binder may be coated using a variety of methods known in the art to produce a thin, uniform coating. Examples of acceptable coating methods include gravure coating, air knife coating, application roll coating, or curtain coating. The coated binder may coated with or without a cross-linker that consists of a styrene acrylate, styrene butadiene methacrylate, styrene sulfonates, or hydroxy ethyl cellulose, or some mixture there of. These binders may be used alone to achieve the desired high frequency roughness, or combined with any of the particulates described above to achieve said roughness. The preferred class of binder materials consists of an addition product of from about 30 to 78 mol % of an alkyl methacrylate wherein the alkyl group has from 3 to 8 carbon atoms, from about 2 to about 10 mol % of an alkali metal salt of an ethylenically unsaturated sulfonic acid and from 20 to about 65 mol % of a vinyl benzene, the polymer having a glass transition point of from 30 to 65° C. When properly formulated, coated, and dried, the coalescence of the latex produces a high frequency roughness in combination with or without colloidal silica that is particularly useful for back marking and photofinishing back printing retention.

An example of a preferred material to provide the high frequency roughness is styrene butadiene methacrylate coated onto a biaxially oriented skin layer consisting of a copolymer of polyethylene and a terpolymer comprising ethylene, propylene, and butylene. The styrene butadiene methacrylate is coated at 25 grams/$m^2$ using gravure/backing coating roll system. The styrene butadiene methacrylate coating is dried to a surface temperature of 55° C. The biaxially oriented sheet of this example contains a low frequency component from the biaxially copolymer formulation and a high frequency component from the coated layer of styrene butadiene methacrylate.

In order to successfully transport a photographic paper that contains a laminated biaxially oriented sheet with the desired surface roughness on the opposite side of the image layer, an antistatic coating on the bottommost layer is preferred. The antistat coating may contain any known materials known in the art which are coated on photographic web materials to reduce static during the transport of photographic paper. The preferred surface resistivity of the antistat coating at 50% RH is less than $10^{13}$ ohm/square.

These biaxially oriented sheets may be coated or treated after the coextrusion and orienting process or between casting and full orientation with any number of coatings which may be used to improve the properties of the sheets including printability, to provide a vapor barrier, to make them heat sealable, or to improve the adhesion to the support or to the photosensitive layers. Examples of this would be acrylic coatings for printability and coating polyvinylidene chloride for heat seal properties. Further examples include flame, plasma, or corona discharge treatment to improve printability or adhesion.

A substantially transparent magnetic recording layer is preferably applied to the bottom biaxially oriented polymer sheet. A magnetic recording layer can be used to record photographic processing information such as date and time of processing, voice or data from the capture device, or can be used to store a digital file of the printed image. By "substantially transparent" it is meant that the magnetic particles are sufficiently dispersed and are of a size and distribution to permit substantial transmittance greater than 60% of visible light through the magnetic recording layer. More specifically, the substantially transparent magnetic recording layer of the invention increases the optical density of the backside biaxially oriented sheet by less than 0.2 optical density units across the visible portion of the spectrum from 400 nm to 700 nm.

In forming the transparent magnetic recording layer, magnetic particles with a surface area of 30 $m^2$/gram are applied in a coated layer having a dried thickness less than 1.5 $\mu$m. The magnetic particles are homogeneously dispersed in a transparent binder and a solvent for the binder. An example of a magnetic binder is cellulose organic acid esters. Suitable solvents include methylene chloride, methyl alcohol, methyl ethyl ketone, methyl isobutyl ketone, ethyl acetate, butyl acetate, cyclohexanone, butyl alcohol, and mixtures thereof. The dispersing medium can also contain transparent addenda such as plasticizers and dispersing agents.

The support to which the microvoided composite sheets and biaxially oriented sheets are laminated for the laminated support of the photosensitive silver halide layer may be a polymeric, a synthetic paper, cloth, woven polymer fibers, or a cellulose fiber paper support, or laminates thereof. The preferred support is a photographic grade cellulose fiber paper. In the case of silver halide photographic systems, suitable cellulose papers must not interact with the light sensitive emulsion layer. A photographic grade paper used in this invention must be "smooth" as to not interfere with the viewing of images. The surface roughness of cellulose paper or $R_a$ is a measure of relatively finely spaced surface irregularities on the paper. The surface roughness measurement is a measure of the maximum allowable roughness height expressed in units of micrometers and by use of the symbol $R_a$. For the paper of this invention, long wavelength surface roughness or orange peel is of interest. For the irregular surface profile of the paper of this invention, a 0.95 cm diameter probe is used to measure the surface roughness of the paper and, thus, bridge all fine roughness detail. The preferred surface roughness of the paper is between 0.13 and 0.44 $\mu$m. At surface roughness greater than 0.44 $\mu$m, little improvement in image quality is observed when compared to current photographic papers. A cellulose paper surface roughness less than 0.13 $\mu$m is difficult to manufacture and costly.

The preferred basis weight of the cellulose paper is between 117.0 and 195.0 g/$m^2$. A basis weight less than 117.0 g/$m^2$ yields an imaging support that does not have the required stiffness for transport through photofinishing equipment and digital printing hardware. Additionally, a basis weight less than 117.0 g/$m^2$ yields an imaging support that does not have the required stiffness for consumer acceptance. At basis weights greater than 195.0 g/$m^2$, the imaging support stiffness, while acceptable to consumers, exceeds the stiffness requirement for efficient photofinishing. Problems, such as the inability to be chopped and incomplete punches, are common with a cellulose paper that exceeds 195.0 g/$m^2$ in basis weight. The preferred fiber length of the paper of this invention is between 0.40 and 0.58 mm. Fiber Lengths are measured using a FS-200 Fiber Length Analyzer (Kajaani Automation, Inc.). Fiber lengths less than 0.35 mm are difficult to achieve in manufacturing and, as a result, expensive. Because shorter fiber lengths generally result in an increase in paper modulus, paper fiber lengths less than 0.35 mm will result in a photographic paper this is very difficult to punch in photofinishing equipment. Paper fiber lengths greater than 0.62 mm do not show an improvement in surface smoothness.

The preferred density of the cellulose paper is between 1.05 and 1.20 g/cc. A sheet density less than 1.05 g/cc would not provide the smooth surface preferred by consumers. A sheet density that is greater than 1.20 g/cc would be difficult to manufacture, requiring expensive calendering and a loss in machine efficiency.

The machine direction to cross direction modulus is critical to the quality of the imaging support, as the modulus ratio is a controlling factor in imaging element curl and a balanced stiffness in both the machine and cross directions. The preferred machine direction to cross direction modulus ratio is between 1.4 and 1.9. A modulus ratio of less than 1.4 is difficult to manufacture since the cellulose fibers tend to align primarily with the stock flow exiting the paper machine head box. This flow is in the machine direction and is only counteracted slightly by fourdrinier parameters. A modulus ratio greater than 1.9 does not provide the desired curl and stiffness improvements to the laminated imaging support.

A cellulose paper substantially free of $TiO_2$ may be formed in a low cost photographic reflective print as the opacity of the imaging support can be improved by laminating a microvoided biaxially oriented sheet to the cellulose paper of this invention. The elimination of $TiO_2$ from the cellulose paper for the low cost photographic paper significantly improves the efficiency of the paper making process, eliminating the need for cleaning unwanted $TiO_2$ deposits on critical machine surfaces.

For a premium photographic paper the use of $TiO_2$ in the paper base is preferred to improve the opacity of the photographic element. $TiO_2$ added to the paper base reduces unwanted transmission of ambient light which interferes with the viewing of images by consumers. The $TiO_2$ used may be either anatase or rutile type. Examples of $TiO_2$ that are acceptable for addition of cellulose paper are DuPont Chemical Co. R101 rutile $TiO_2$ and DuPont Chemical Co. R104 rutile $TiO_2$. Other pigments to improve photographic responses may also be used in this invention. Pigments such as talc, kaolin, $CaCO_3$, $BaSO_4$, ZnO, $TiO_2$, ZnS, and $MgCO_3$ are useful and may be used alone or in combination with $TiO_2$.

For an additional improvement in base paper opacity, the use of dyes in the paper base is preferred. The dyes added to the cellulose paper improves opacity, as the fiber and the dye in the paper each absorbs and scatters light independently of each other, and the opacifying effects are additive. The preferred opacifying dye added to the cellulose paper is a blue dye. Blue dyes are preferred, as they have been shown to provide high opacity and are perceived by the consumer as acceptable, as consumers prefer blue-white papers to yellow-white or green-white papers. Blue dye may also be used in combination with $TiO_2$, as the opacity effects of the $TiO_2$ and blue dye have been shown to be additive and produce a cellulose paper base that is high in opacity.

A cellulose paper substantially free of dry strength resin and wet strength resin is preferred because the elimination of dry and wet strength resins reduces the cost of the cellulose paper and improves manufacturing efficiency. Dry strength and wet strength resins are commonly added to cellulose photographic paper to provide strength in the dry state and strength in the wet state, as the paper is developed in wet processing chemistry during the photofinishing of consumer images. In this invention, dry and wet strength resin are no longer needed as the strength of the imaging support is the result of laminating high strength biaxially oriented polymer sheets to the top and bottom of the cellulose paper.

Any pulps known in the art to provide image quality paper may be used in this invention. Bleached hardwood chemical kraft pulp is preferred as it provides brightness, a good starting surface, and good formation, while maintaining strength. In general, hardwood fibers are much shorter than softwood by approximately a 1:3 ratio. Pulp with a brightness less than 90% Brightness at 457 nm is preferred. Pulps with brightness of 90% or greater are commonly used in imaging supports because consumers typically prefer a white paper appearance. A cellulose paper less than 90% Brightness at 457 nm is preferred, as the whiteness of the imaging support can be improved by laminating a microvoided biaxially oriented sheet to the cellulose paper of this invention. The reduction in brightness of the pulp allows for a reduction in the amount of bleaching required, thus lowering the cost of the pulp and reducing the bleaching load on the environment.

The cellulose paper of this invention can be made on a standard continuous fourdrinier wire machine. For the formation of cellulose paper of this invention, it is necessary to refine the paper fibers to a high degree to obtain good formation. This is accomplished in this invention by providing wood fibers suspended in water, bringing said fibers into contact with a series of disc refining mixers and conical refining mixers such that fiber development in disc refining is carried out at a total specific net refining power of 44 to 66 KW hrs/metric ton, and cutting in the conical mixers is carried out at a total specific net refining power of between 55 and 88 KW hrs/metric ton, applying said fibers in water to a foraminous member to remove water, drying said paper between press and felt, drying said paper between cans, applying a size to said paper, drying said paper between steam heated dryer cans, applying steam to said paper, and passing said paper through calender rolls. The preferred specific net refining power (SNRP) of cutting is between 66 and 77 KW hrs/metric ton. A SNRP of less than 66 KW hrs/metric ton will provide an inadequate fiber length reduction resulting in a less smooth surface. A SNRP of greater than 77 KW hrs/metric ton after disc refining described above generates a stock slurry that is difficult to drain from the fourdrinier wire. Specific Net Refiner Power is calculated by the following formula: (Applied Power in Kilowatts to the refiner−the No Load Kilowatts)/(0.251*% consistency*flow rate in gpm*0.907 metric tons/ton).

For the formation of cellulose paper of sufficient smoothness, it is desirable to rewet the paper surface prior final calendering. Papers made on the paper machine with a high moisture content calendar much more readily that papers of the same moisture content containing water added in a remoistening operation. This is due to a partial irreversibility in the imbition of water by cellulose. However, calendering a paper with high moisture content results in blackening, a condition of transparency resulting from fibers being crushed in contact with each other. The crushed areas reflect less light and, therefore, appear dark, a condition that is undesirable in an imaging application such as a base for color paper. By adding moisture to the surface of the paper after the paper has been machine dried, the problem of blackening can be avoided while preserving the advantages of high moisture calendering. The addition of surface moisture prior to machine calendering is intended to soften the surface fibers and not the fibers in the interior of the paper. Papers calendered with a high surface moisture content generally show greater strength, higher surface density, and image gloss, all of which are desirable for an imaging support and all of which have been shown to be perceptually preferred to prior art photographic paper bases.

There are several paper surface humidification/moisturization techniques. The application of water, either by mechanical roller or aerosol mist by way of an electrostatic field, are two techniques known in the art. The above techniques require dwell time, hence web length, for the water to penetrate the surface and equalize in the top surface of the paper. Therefore, it is difficult for these above systems to make moisture corrections without distorting, spotting, and swelling of the paper. The preferred method to rewet the paper surface prior final calendering is by use of a steam shower. A steam shower uses saturated steam in a controlled atmosphere to cause water vapor to penetrate the surface of the paper and condense. Prior to calendering, the steam shower allows a considerable improvement in gloss and smoothness due to the heating up and moisturizing the paper of this invention before the pressure nip of the calendering rolls. An example of a commercially available system that allows for controlled steam moisturization of the surface of cellulose paper is the "Fluidex System" manufactured by Pagendarm Corp.

For imaging supports, the use of a steam on the face side of the paper only is preferred since improved surface smoothness has commercial value for the imaging side of the paper. Application of the steam shower to both sides of the paper, while feasible, is unnecessary and adds additional cost to the product.

The preferred moisture content by weight after applying the steam and calendering is between 7% and 9%. A moisture level less than 7% is more costly to manufacture since more fiber is needed to reach a final basis weight. At a moisture level greater than 10% the surface of the paper begins to degrade. After the steam shower rewetting of the paper surface, the paper is calendered before winding of the paper. The preferred temperature of the calender rolls is between 76° C. and 88° C. Lower temperatures result in a poor surface. Higher temperatures are undesirable, as they require more energy and have been found to increase paper moisture variability during winding.

When using a cellulose fiber paper support, it is preferable to extrusion laminate the microvoided composite sheets to the base paper using a polyolefin resin. Extrusion laminating is carried out by bringing together the biaxially oriented sheets of the invention and the base paper with application of an adhesive between them, followed by their being pressed in a nip such as between two rollers. The adhesive may be applied to either the biaxially oriented sheets or the base paper prior to their being brought into the nip. In a preferred form the adhesive is applied into the nip simultaneously with the biaxially oriented sheets and the base paper.

The bonding agent used for bonding biaxially oriented sheets to cellulose photographic paper is preferably selected from a group of resins that can be melt extruded at about 160° C. to 300° C. Usually, a polyolefin resin such as polyethylene or polypropylene is used.

Adhesive resins are preferred for bonding biaxially oriented sheets to photographic grade cellulose paper over polyethylene. An adhesive resin used in this invention is one that can be melt extruded and provide sufficient bond strength between the cellulose paper and the biaxially oriented sheet. For use in the conventional photographic system, peel forces between the paper and the biaxially oriented sheets need to be greater than 150 grams/5 cm to prevent delamination during the manufacture of the photographic base, during processing of an image, or in the final image format. "Peel strength" or "separation force" or "peel force" is the measure of the amount of force required to separate the biaxially oriented sheets from the base paper. Peel strength is measured using an Instron gauge and the 180 degree peel test with a cross head speed of 1.0 meters/min. The sample width is 5 cm and the distance peeled is 10 cm.

In the case of a silver halide photographic system, suitable adhesive resins must also not interact with the light sensitive emulsion layer. Preferred examples of adhesive resins are ionomer (e.g., an ethylene metharylic acid copolymer cross linked by metal ions such as Na ions or Zn ions), ethylene vinyl acetate copolymer, ethylene methyl methacrylate copolymer, ethylene ethyl acrylate copolymer, ethylene methyl acrylate copolymer, ethylene acrylic acid copolymer, ethylene ethyl acrylate maleic anhydride copolymer, or ethylene methacrylic acid copolymer. These adhesive resins are preferred because they can be easily melt extruded and provide peel forces between biaxially oriented polyolefin sheets and base paper greater than 150 grams/5 cm.

Metallocene catalyzed polyolefin plastomers are most preferred for bonding oriented polyolefin sheets to photographic base paper because they offer a combination of excellent adhesion to smooth biaxially oriented polyolefin sheets, are easily melt extruded using conventional extrusion equipment, and are low in cost when compared to other adhesive resins. Metallocenes are class of highly active olefin catalysts that are used in the preparation of polyolefin plastomers. These catalysts, particularly those based on group IVB transition metals such as zirconium, titanium, and hafnium, show extremely high activity in ethylene polymerization. Various forms of the catalyst system of the metallocene type may be used for polymerization to prepare the polymers used for bonding biaxially oriented polyolefin sheets to cellulose paper. Forms of the catalyst system include, but are not limited to, those of homogeneous, supported catalyst type, high pressure process or a slurry or a solution polymerization process. The metallocene catalysts are also highly flexible in that, by manipulation of catalyst composition and reaction conditions, they can be made to provide polyolefins with controllable molecular weights. Suitable polyolefins include polypropylene, polyethylene, polymethylpentene, polystyrene, polybutylene, and mixtures thereof. Development of these metallocene catalysts for the polymerization of ethylene is found in U.S. Pat. No. 4,937,299 (Ewen et al).

The most preferred metallcoene catalyzed copolymers are very low density polyethylene (VLDPE) copolymers of ethylene and a $C_4$ to $C_{10}$ alpha monolefin, most preferably copolymers and terpolymers of ethylene and butene-1 and hexene-1. The melt index of the metallocene catalyzed ethylene plastomers preferably fall in a range of 2.5 g/10 min to 27 g/10 min. The density of the metallocene catalyzed ethylene plastomers preferably falls in a range of 0.8800 to 0.9100. Metallocene catalyzed ethylene plastomers with a density greater than 0.9200 do not provide sufficient adhesion to biaxially oriented polyolefin sheets.

Melt extruding metallocene catalyzed ethylene plastomers presents some processing problems. Processing results from earlier testing in food packaging applications indicated that their coating performance, as measured by the neck-in to draw-down performance balance, was worse than conventional low density polyethylene, making the use of metallocene catalyzed plastomers difficult in a single layer melt extrusion process that is typical for the production of current photographic support. By blending low density polyethylene with the metallocene catalyzed ethylene plastomer, acceptable melt extrusion coating performance was obtained, making the use of metallocene catalyzed plastomers blended with low density polyethylene (LDPE) very efficient. The preferred level of low density polyethylene to be added is dependent on the properties of the LDPE used (properties such as melt index, density, and type of long chain branching) and the properties of the metallocene catalyzed ethylene plastomer selected. Since metallocene catalyzed ethylene plastomers are more expensive than LDPE, a cost to benefit trade-off is necessary to balance material cost with processing advantages, such as neck-in and product advantages such as biaxially oriented film adhesion to paper. In general the preferred range of LDPE blended is 10% to 80% by weight.

The bonding layer may also contain pigments which are known to improve the photographic responses such as whiteness or sharpness. Titanium dioxide is preferred and used in this invention to improve image sharpness. The $TiO_2$ used may be either anatase or rutile type. In the case of whiteness, anatase is the preferred type. In the case of sharpness, rutile is the preferred. Further, both anatase and rutile $TiO_2$ may be blended to improve both whiteness and sharpness. Examples of $TiO_2$ that are acceptable for a photographic system are DuPont Chemical Co. R101 rutile $TiO_2$ and DuPont Chemical Co. R104 rutile $TiO_2$. Other pigments to improve photographic responses may also be used in this invention. Examples of other white pigments include talc, kaolin, $CaCO_3$, $BaSO_4$, ZnO, $TiO_2$, ZnS, and $MgCO_3$. The preferred weigh percent of $TiO_2$ added to the bonding layer is between 12% and 18%. The addition of $TiO_2$ less than 8% does not significantly impact the optical performance of the image. $TiO_2$ greater than 24% decreases manufacturing efficiency, as problems such as extrusion pigment die lines are encountered.

The bonding layer may also contain addenda known in the art to absorb light. A light absorbing layer in this invention is used to improve optical properties of an image, properties such as opacity and image resolution. An example of a light absorbing material and can be added to the bonding layer is an extrusion grade of carbon black. Carbon black addenda are produced by the controlled combustion of liquid hydrocarbons and can be added to the bonding layer prior to melt extrusion.

In the manufacturing process for this invention, preferred bonding agents are melt extruded from a slit die. In general, a T die or a coat hanger die are preferably used. The melt temperature of the preferred bonding agent is 240° C. to 325° C. Extrusion lamination is carried out by bringing together the biaxially oriented sheet and the base paper with application of the bonding agent between the base paper and the biaxially oriented sheet followed by their being pressed together in a nip such as between two rollers. The total thickness of the bonding layer can range from 2.5 μm to 25 μm, preferably from 3.8 μm to 13 μm. Below 3.8 μm it is difficult to maintain a consistent melt extruded bonding layer thickness. At thickness higher than 13 μm there is little improvement in biaxially oriented sheet adhesion to paper.

During the lamination process, it is desirable to maintain control of the tension of the biaxially oriented sheet(s) in order to minimize curl in the resulting laminated support. For high humidity applications (>50% RH) and low humidity applications (<20% RH), it is desirable to laminate both a front side and back side film to keep curl to a minimum.

In one preferred embodiment, in order to produce photographic elements with a desirable photographic look and feel, it is preferable to use relatively thick paper supports (e.g., at least 120 mm thick, preferably from 120 to 250 mm thick) and relatively thin microvoided composite sheets (e.g., less than 50 mm thick, preferably from 20 to 50 mm thick, and more preferably from 30 to 50 mm thick).

A photographic element comprising at least one photosensitive silver halide layer comprising at least one dye forming coupler, a support comprising paper having laminated thereto a top and bottom sheet comprising biaxially oriented polyolefin sheets, wherein said photographic element has a surface roughness of between 0.15 and 0.50 μm and an average stiffness of between 150 and 300 millinewtons, a stiffness ratio between machine direction and cross direction of between 0.8 and 1.2, between 20 and 70% humidity a maximum curl value of 10 curl units, said photographic element has a back roughness of between 0.30 and 2.00 μm, and has a tear strength of between 300 and 900 N is preferred. This combination of stiffness, surface roughness, backside roughness, tear strength, and curl is perceptually preferred over typical low cost prior art photographic papers and, thus, has significant commercial value.

A photographic element comprising at least one photosensitive silver halide layer comprising at least one dye forming coupler, a support comprising paper having laminated thereto a top and bottom sheet comprising biaxially oriented polyolefin sheets, wherein said photographic element has a surface roughness of between 0.02 and 0.25 μm and an average stiffness of between 180 and 220 millinewtons, a stiffness ratio between machine direction and cross direction of between 0.8 and 1.2, between 20 and 70% humidity a maximum curl value of 10 curl units, said photographic element has a back roughness of between 0.30 and 2.00 μm, has a tear strength of between 300 and 900 N, a sharpness of greater than 78 MTF, an opacity of greater than 95.0, and a whiteness greater than 94 is preferred. This combination of surface roughness, backside roughness, stiffness, curl, tear strength, image sharpness, opacity, and whiteness has been found to both superior and perceptually preferred to typical premium photographic papers and, thus, has significant commercial value.

As used herein, the phrase "imaging element" is a material that may be used as a laminated support for the transfer of images to the support by techniques, such as ink jet printing or thermal dye transfer, as well as a support for silver halide images. As used herein, the phrase "photographic element" is a material that utilizes photosensitive silver halide in the formation of images. Because the support utilized in this invention is superior to prior art imaging supports for image gloss, tear resistance, curl resistance, and whiteness, the support materials of the invention may be utilized for digital printing technologies.

The thermal dye image-receiving layer of the receiving elements of the invention may comprise, for example, a polycarbonate, a polyurethane, a polyester, polyvinyl chloride, poly(styrene-co-acrylonitrile), poly(caprolactone), or mixtures thereof. The dye image-receiving layer may be present in any amount which is effective for the intended purpose. In general, good results have been obtained at a concentration of from about 1 to about 10 $g/m^2$. An overcoat layer may be further coated over the dye-receiving layer, such as described in U.S. Pat. No. 4,775,657 of Harrison et al.

Dye-donor elements that are used with the dye-receiving element of the invention conventionally comprise a support having thereon a dye containing layer. Any dye can be used in the dye-donor employed in the invention, provided it is transferable to the dye-receiving layer by the action of heat. Especially good results have been obtained with sublimable dyes. Dye donors applicable for use in the present invention are described, e.g., in U.S. Pat. Nos. 4,916,112; 4,927,803; and 5,023,228.

As noted above, dye-donor elements are used to form a dye transfer image. Such a process comprises image-wise-heating a dye-donor element and transferring a dye image to a dye-receiving element as described above to form the dye transfer image.

In a preferred embodiment of the thermal dye transfer method of printing, a dye donor element is employed which compromises a poly-(ethylene terephthalate) support coated with sequential repeating areas of cyan, magenta, and yellow dye, and the dye transfer steps are sequentially performed for each color to obtain a three-color dye transfer image. Of course, when the process is only performed for a single color, then a monochrome dye transfer image is obtained.

Thermal printing heads which can be used to transfer dye from dye-donor elements to receiving elements of the invention are available commercially. There can be employed, for example, a Fujitsu Thermal Head (FTP-040 MCS001), a TDK Thermal Head F415 HH7-1089, or a Rohm Thermal Head KE 2008-F3. Alternatively, other known sources of energy for thermal dye transfer may be used, such as lasers as described in, for example, GB No. 2,083,726A.

A thermal dye transfer assemblage of the invention comprises (a) a dye-donor element, and (b) a dye-receiving element as described above, the dye-receiving element being in a superposed relationship with the dye-donor element so that the dye layer of the donor element is in contact with the dye image-receiving layer of the receiving element.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner.

The electrographic and electrophotographic processes and their individual steps have been well described in detail in many books and publications. The processes incorporate the basic steps of creating an electrostatic image, developing that image with charged, colored particles (toner), optionally transferring the resulting developed image to a secondary substrate, and fixing the image to the substrate. There are numerous variations in these processes and basic steps; the use of liquid toners in place of dry toners is simply one of those variations.

The first basic step, creation of an electrostatic image, can be accomplished by a variety of methods. The electrophotographic process of copiers uses imagewise photodischarge, through analog or digital exposure, of a uniformly charged photoconductor. The photoconductor may be a single-use system, or it may be rechargeable and reimageable, like those based on selenium or organic photorecptors.

In one form of the electrophotographic process, copiers use imagewise photodischarge, through analog or digital exposure, of a uniformly charged photoconductor. The photoconductor may be a single-use system, or it may be rechargeable and reimageable, like those based on selenium or organic photoreceptors.

In one form of the electrophotographic process, a photosensitive element is permanently imaged to form areas of differential conductivity. Uniform electrostatic charging, followed by differential discharge of the imaged element, creates an electrostatic image. These elements are called electrographic or xeroprinting masters because they can be repeatedly charged and developed after a single imaging exposure.

In an alternate electrographic process, electrostatic images are created iono-graphically. The latent image is created on dielectric (charge-holding) medium, either paper or film. Voltage is applied to selected metal styli or writing nibs from an array of styli spaced across the width of the medium, causing a dielectric breakdown of the air between the selected styli and the medium. Ions are created, which form the latent image on the medium.

Electrostatic images, however generated, are developed with oppositely charged toner particles. For development with liquid toners, the liquid developer is brought into direct contact with the electrostatic image. Usually a flowing liquid is employed to ensure that sufficient toner particles are available for development. The field created by the electrostatic image causes the charged particles, suspended in a nonconductive liquid, to move by electrophoresis. The charge of the latent electrostatic image is thus neutralized by the oppositely charged particles. The theory and physics of electrophoretic development with liquid toners are well described in many books and publications.

If a reimageable photoreceptor or an electrographic master is used, the toned image is transferred to paper (or other substrate). The paper is charged electrostatically, with the polarity chosen to cause the toner particles to transfer to the paper. Finally, the toned image is fixed to the paper. For self-fixing toners, residual liquid is removed from the paper by air-drying or heating. Upon evaporation of the solvent, these toners form a film bonded to the paper. For heat-fusible toners, thermoplastic polymers are used as part of the particle. Heating both removes residual liquid and fixes the toner to paper.

The dye receiving layer (DRL) for ink jet imaging may be applied by any known methods, such as solvent coating or melt extrusion coating techniques. The DRL is coated over the tie layer (TL) at a thickness ranging from 0.1–10 $\mu$m, preferably 0.5–5 $\mu$m. There are many known formulations which may be useful as dye receiving layers. The primary requirement is that the DRL is compatible with the inks which it will be imaged so as to yield the desirable color gamut and density. As the ink drops pass through the DRL, the dyes are retained or mordanted in the DRL, while the ink solvents pass freely through the DRL and are rapidly absorbed by the TL. Additionally, the DRL formulation is preferably coated from water, exhibits adequate adhesion to the TL, and allows for easy control of the surface gloss.

For example, Misuda et al. in U.S. Pat. Nos. 4,879,166; 5,264,275; 5,104,730; 4,879,166; and Japanese Patents 1,095,091; 2,276,671; 2,276,670; 4,267,180; 5,024,335; and 5,016,517 discloses aqueous based DRL formulations comprising mixtures of psuedo-bohemite and certain water soluble resins. Light, in U.S. Pat. Nos. 4,903,040; 4,930,041; 5,084,338; 5,126,194; 5,126,195; 5,139,8667; and 5,147,717 discloses aqueous-based DRL formulations comprising mixtures of vinyl pyrrolidone polymers and certain water-dispersible and/or water-soluble polyesters, along with other polymers and addenda. Butters et al., in U.S. Pat. Nos. 4,857,386 and 5,102,717, discloses ink-absorbent resin layers comprising mixtures of vinyl pyrrolidone polymers and acrylic or methacrylic polymers. Sato et al. in U.S. Pat. No. 5,194,317, and Higuma et al. in U.S. Pat. No. 5,059,983 disclose aqueous-coatable DRL formulations based on poly (vinyl alcohol). Iqbal in U.S. Pat. No. 5,208,092 discloses water-based ink receiver layer or IRL formulations comprising vinyl copolymers which are subsequently cross-linked. In addition to these examples, there may be other known or contemplated DRL formulations which are consistent with the aforementioned primary and secondary requirements of the DRL, all of which fall under the spirit and scope of the current invention.

The preferred DRL is a 0.1–10 $\mu$m DRL which is coated as an aqueous dispersion of 5 parts alumoxane and 5 parts poly (vinyl pyrrolidone). The DRL may also contain varying levels and sizes of matting agents for the purpose of controlling gloss, friction, and/or fingerprint resistance, surfactants to enhance surface uniformity and to adjust the surface tension of the dried coating, mordanting agents, antioxidants, UV absorbing compounds, light stabilizers, and the like.

Although the ink-receiving elements, as described above, can be successfully used to achieve the objectives of the present invention, it may be desirable to overcoat the DRL for the purpose of enhancing the durability of the imaged element. Such overcoats may be applied to the DRL either before or after the element is imaged. For example, the DRL can be overcoated with an ink-permeable layer through which inks freely pass. Layers of this type are described in U.S. Pat. Nos. 4,686,118; 5,027,131; and 5,102,717 in European Patent Specification 0 524 626. Alternatively, an overcoat may be added after the element is imaged. Any of the known laminating films and equipment may be used for this purpose. The inks used in the aforementioned imaging process are well known, and the ink formulations are often closely tied to the specific processes, i.e., continuous, piezoelectric, or thermal. Therefore, depending on the specific ink process, the inks may contain widely differing amounts and combinations of solvents, colorants, preservatives, surfactants, humectants, and the like. Inks preferred for use in combination with the image recording elements of the present invention are water-based, such as those currently sold for use in the Hewlett-Packard Desk Writer 560C printer. However, it is intended that alternative embodiments of the image-recording elements as described above, which may be formulated for use with inks which are specific to a given ink-recording process or to a given commercial vendor, fall within the scope of the present invention.

Printing generally accomplished by Flexographic or Rotogravure. Flexography is an offset letterpress technique where the printing plates are made from rubber or photopolymers. The printing is accomplished by the transfer of the ink from the raised surface of the printing plate to the support of this invention. The Rotogravure method of printing uses a print cylinder with thousands of tiny cells which are below the surface of the printing cylinder. The ink is transferred from the cells when the print cylinder is brought into contact with the web at the impression roll.

Suitable inks for this invention include solvent based inks, water based inks, and radiation cured inks. Examples of solvent based inks include nitrocellulose maleic, nitrocellulose polyamide, nitrocellulose acrylic, nitrocellulose urethane, chlorinated rubber, vinyl, acrylic, alcohol soluble acrylic, cellulose acetate acrylic styrene, and other synthetic polymers. Examples of water based inks include acrylic emulsion, maleic resin dispersion, styrene maleic anhydride resins, and other synthetic polymers. Examples of radiation cured inks include ultraviolet and electron beam cure inks.

When the support of this invention is printed with Flexographic or Rotogravure inks, a ink adhesion coating may be required to allow for efficient printing of the support. The top layer of the biaxially oriented sheet may be coated with any materials known in the art to improve ink adhesion to biaxially oriented polyolefin sheets of this invention. Examples include acrylic coatings and polyvinyl alcohol coatings. Surface treatments to the biaxially oriented sheets of this invention may also be used to improve ink adhesion. Examples include corona and flame treatment.

The photographic elements can be black-and-white, single color elements, or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

The photographic emulsions useful for this invention are generally prepared by precipitating silver halide crystals in a colloidal matrix by methods conventional in the art. The colloid is typically a hydrophilic film forming agent such as gelatin, alginic acid, or derivatives thereof.

The crystals formed in the precipitation step are washed and then chemically and spectrally sensitized by adding spectral sensitizing dyes and chemical sensitizers, and by providing a heating step during which the emulsion temperature is raised, typically from 40° C. to 70° C., and maintained for a period of time. The precipitation and spectral and chemical sensitization methods utilized in preparing the emulsions employed in the invention can be those methods known in the art.

Chemical sensitization of the emulsion typically employs sensitizers such as: sulfur-containing compounds, e.g., allyl isothiocyanate, sodium thiosulfate and allyl thiourea; reducing agents, e.g., polyamines and stannous salts; noble metal compounds, e.g., gold, platinum; and polymeric agents, e.g., polyalkylene oxides. As described, heat treatment is employed to complete chemical sensitization. Spectral sensitization is effected with a combination of dyes, which are designed for the wavelength range of interest within the visible or infrared spectrum. It is known to add such dyes both before and after heat treatment.

After spectral sensitization, the emulsion is coated on a support. Various coating techniques include dip coating, air knife coating, curtain coating, and extrusion coating.

The silver halide emulsions utilized in this invention may be comprised of any halide distribution. Thus, they may be comprised of silver chloride, silver bromide, silver bromochloride, silver chlorobromide, silver iodochloride, silver iodobromide, silver bromoiodochloride, silver chloroiodobromide, silver iodobromochloride, and silver iodochlorobromide emulsions. It is preferred, however, that the emulsions be predominantly silver chloride emulsions. By predominantly silver chloride, it is meant that the grains of the emulsion are greater than about 50 mole percent silver chloride. Preferably, they are greater than about 90 mole percent silver chloride and optimally greater than about 95 mole percent silver chloride.

The silver halide emulsions can contain grains of any size and morphology. Thus, the grains may take the form of cubes, octahedrons, cubo-octahedrons, or any of the other naturally occurring morphologies of cubic lattice type silver halide grains. Further, the grains may be irregular such as spherical grains or tabular grains. Grains having a tabular or cubic morphology are preferred.

The photographic elements of the invention may utilize emulsions as described in The Theory of the Photographic Process, Fourth Edition, T. H. James, Macmillan Publishing Company, Inc., 1977, pages 151–152. Reduction sensitization has been known to improve the photographic sensitivity of silver halide emulsions. While reduction sensitized silver halide emulsions generally exhibit good photographic speed, they often suffer from undesirable fog and poor storage stability.

Reduction sensitization can be performed intentionally by adding reduction sensitizers, chemicals which reduce silver ions to form metallic silver atoms, or by providing a reducing environment such as high pH (excess hydroxide ion) and/or low pAg (excess silver ion). During precipitation of a silver halide emulsion, unintentional reduction sensitization can occur when, for example, silver nitrate or alkali solutions are added rapidly or with poor mixing to form emulsion grains. Also, precipitation of silver halide emulsions in the presence of ripeners (grain growth modifiers) such as thioethers, selenoethers, thioureas, or ammonia tends to facilitate reduction sensitization.

Examples of reduction sensitizers and environments which may be used during precipitation or spectral/chemical sensitization to reduction sensitize an emulsion include ascorbic acid derivatives; tin compounds; polyamine compounds; and thiourea dioxide-based compounds described in U.S. Pat. Nos. 2,487,850; 2,512,925; and British Patent 789,823. Specific examples of reduction sensitizers or conditions, such as dimethylamineborane, stannous chloride, hydrazine, high pH (pH 8–11) and low pAg (pAg 1–7) ripening are discussed by S. Collier in Photographic Science and Engineering, 23, 113 (1979). Examples of processes for preparing intentionally reduction sensitized silver halide emulsions are described in EP 0 348 934 A1 (Yamashita), EP 0 369 491 (Yamashita), EP 0 371 388 (Ohashi), EP 0 396 424 A1 (Takada), EP 0 404 142 A1 (Yamada), and EP 0 435 355 A1 (Makino).

The photographic elements of this invention may use emulsions doped with Group VIII metals such as iridium, rhodium, osmium, and iron as described in *Research Disclosure*, September 1994, Item 36544, Section I, published by Kenneth Mason Publications, Ltd., Dudley Annex, 12a North Street, Emsworth, Hampshire PO10 7DQ, ENGLAND. Additionally, a general summary of the use of iridium in the sensitization of silver halide emulsions is contained in Carroll, "Iridium Sensitization: A Literature Review," Photographic Science and Engineering, Vol. 24, No. 6, 1980. A method of manufacturing a silver halide emulsion by chemically sensitizing the emulsion in the presence of an iridium salt and a photographic spectral sensitizing dye is described in U.S. Pat. No. 4,693,965. In some cases, when such dopants are incorporated, emulsions show an increased fresh fog and a lower contrast sensitometric curve when processed in the color reversal E-6 process as described in The British Journal of Photography Annual, 1982, pages 201–203.

A typical multicolor photographic element of the invention comprises the invention laminated support bearing a cyan dye image-forming unit comprising at least one red-sensitive silver halide emulsion layer having associated therewith at least one cyan dye-forming coupler; a magenta image-forming unit comprising at least one green-sensitive silver halide emulsion layer having associated therewith at least one magenta dye-forming coupler; and a yellow dye image-forming unit comprising at least one blue-sensitive silver halide emulsion layer having associated therewith at least one yellow dye-forming coupler. The element may contain additional layers, such as filter layers, interlayers, overcoat layers, subbing layers, and the like. The support of the invention may also be utilized for black-and-white photographic print elements.

The photographic elements may also contain a transparent magnetic recording layer such as a layer containing magnetic particles on the underside of a transparent support, as in U.S. Pat. Nos. 4,279,945 and 4,302,523. Typically, the element will have a total thickness (excluding the support) of from about 5 to about 30 $\mu$m.

The invention may be utilized with the materials disclosed in *Research Disclosure,* 40145 of September 1997. The invention is particularly suitable for use with the materials of the color paper examples of sections XVI and XVII. The couplers of section II are also particularly suitable. The Magenta I couplers of section II, particularly M-7, M-10, M-11, and M-18 set forth below are particularly desirable.

M-7

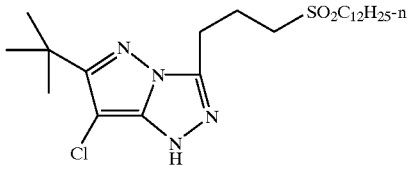

M-10

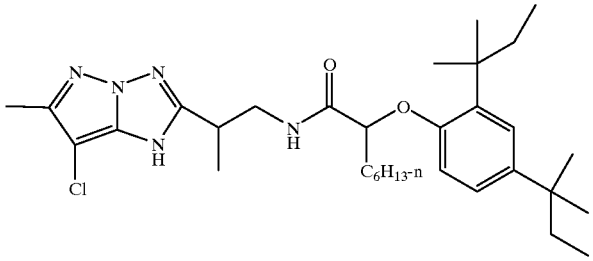

-continued

M-11

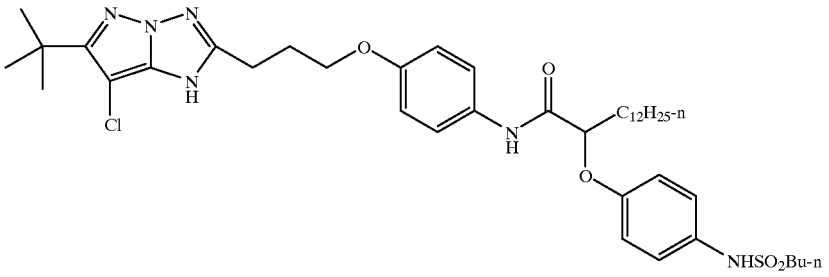

M-18

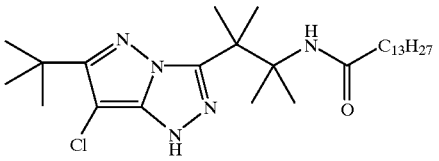

Image dye-forming couplers may be included in the element such as couplers that form cyan dyes upon reaction with oxidized color developing agents which are described in such representative patents and publications as: "Farbkuppler-eine Literature Ubersicht," published in Agfa Mitteilungen, Band III, pp. 156–175 (1961), as well as in U.S. Pat. Nos. 2,367,531; 2,423,730; 2,474,293; 2,772,162; 2,895,826; 3,002,836; 3,034,892; 3,041,236; 4,333,999; 4,746,602; 4,753,871; 4,770,988; 4,775,616; 4,818,667; 4,818,672; 4,822,729; 4,839,267; 4,840,883; 4,849,328; 4,865,961; 4,873,183; 4,883,746; 4,900,656; 4,904,575; 4,916,051; 4,921,783; 4,923,791; 4,950,585; 4,971,898; 4,990,436; 4,996,139; 5,008,180; 5,015,565; 5,011,765; 5,011,766; 5,017,467; 5,045,442; 5,051,347; 5,061,613; 5,071,737; 5,075,207; 5,091,297; 5,094,938; 5,104,783; 5,178,993; 5,813,729; 5,187,057; 5,192,651; 5,200,305 5,202,224; 5,206,130; 5,208,141; 5,210,011; 5,215,871; 5,223,386; 5,227,287; 5,256,526; 5,258,270; 5,272,051; 5,306,610; 5,326,682; 5,366,856; 5,378,596; 5,380,638; 5,382,502; 5,384,236; 5,397,691; 5,415,990; 5,434,034; 5,441,863; EPO 0 246 616; EPO 0 250 201; EPO 0 271 323; EPO 0 295 632; EPO 0 307 927; EPO 0 333 185; EPO 0 378 898; EPO 0 389 817; EPO 0 487 111; EPO 0 488 248; EPO 0 539 034; EPO 0 545 300; EPO 0 556 700; EPO 0 556 777; EPO 0 556 858; EPO 0 569 979; EPO 0 608 133; EPO 0 636 936; EPO 0 651 286; EPO 0 690 344; German OLS 4,026,903; German OLS 3,624,777. and German OLS 3,823,049. Typically such couplers are phenols, naphthols, or pyrazoloazoles.

Couplers that form magenta dyes upon reaction with oxidized color developing agent are described in such representative patents and publications as: "Farbkuppler-eine Literature Ubersicht," published in Agfa Mitteilungen, Band III, pp. 126–156 (1961), as well as U.S. Pat. Nos. 2,311,082 and 2,369,489; 2,343,701; 2,600,788; 2,908,573; 3,062,653; 3,152,896; 3,519,429; 3,758,309; 3,935,015; 4,540,654; 4,745,052; 4,762,775; 4,791,052; 4,812,576; 4,835,094; 4,840,877; 4,845,022; 4,853,319; 4,868,099; 4,865,960; 4,871,652; 4,876,182; 4,892,805; 4,900,657; 4,910,124; 4,914,013; 4,921,968; 4,929,540; 4,933,465; 4,942,116; 4,942,117; 4,942,118; U.S. Pat. Nos. 4,959,480; 4,968,594; 4,988,614; 4,992,361; 5,002,864; 5,021,325; 5,066,575; 5,068,171; 5,071,739; 5,100,772; 5,110,942; 5,116,990; 5,118,812; 5,134,059; 5,155,016; 5,183,728; 5,234,805; 5,235,058; 5,250,400; 5,254,446; 5,262,292; 5,300,407; 5,302,496; 5,336,593; 5,350,667; 5,395,968; 5,354,826; 5,358,829; 5,368,998; 5,378,587; 5,409,808; 5,411,841; 5,418,123; 5,424,179; EPO 0 257 854; EPO 0 284 240; EPO 0 341 204; EPO 347,235; EPO 365,252; EPO 0 422 595; EPO 0 428 899; EPO 0 428 902; EPO 0 459 331; EPO 0 467 327; EPO 0 476 949; EPO 0 487 081; EPO 0 489 333; EPO 0 512 304; EPO 0 515 128; EPO 0 534 703; EPO 0 554 778; EPO 0 558 145; EPO 0 571 959; EPO 0 583 832; EPO 0 583 834; EPO 0 584 793; EPO 0 602 748; EPO 0 602 749; EPO 0 605 918; EPO 0 622 672; EPO 0 622 673; EPO 0 629 912; EPO 0 646 841, EPO 0 656 561; EPO 0 660 177; EPO 0 686 872; WO 90/10253; WO 92/09010; WO 92/10788; WO 92/12464; WO 93/01523; WO 93/02392; WO 93/02393; WO 93/07534; UK Application 2,244,053; Japanese Application 03192-350; German OLS 3,624,103; German OLS 3,912,265; and German OLS 40 08 067. Typically such couplers are pyrazolones, pyrazoloazoles, or pyrazolobenzimidazoles that form magenta dyes upon reaction with oxidized color developing agents.

Couplers that form yellow dyes upon reaction with oxidized color developing agent are described in such representative patents and publications as: "Farbkuppler-eine Literature Ubersicht," published in Agfa Mitteilungen; Band III; pp. 112–126 (1961), as well as U.S. Pat. Nos. 2,298,443; 2,407,210; 2,875,057; 3,048,194; 3,265,506; 3,447,928; 4,022,620; 4,443,536; 4,758,501; 4,791,050; 4,824,771; 4,824,773; 4,855,222; 4,978,605; 4,992,360; 4,994,361; 5,021,333; 5,053,325; 5,066,574; 5,066,576; 5,100,773; 5,118,599; 5,143,823; 5,187,055; 5,190,848; 5,213,958; 5,215,877; 5,215,878; 5,217,857; 5,219,716; 5,238,803; 5,283,166; 5,294,531; 5,306,609; 5,328,818; 5,336,591; 5,338,654; 5,358,835; 5,358,838; 5,360,713; 5,362,617; 5,382,506; 5,389,504; 5,399,474;. 5,405,737; 5,411,848; 5,427,898; EPO 0 327 976; EPO 0 296 793; EPO 0 365 282; EPO 0 379 309; EPO 0 415 375; EPO 0 437 818; EPO 0 447 969; EPO 0 542 463; EPO 0 568 037; EPO 0 568 196; EPO 0 568 777; EPO 0 570 006; EPO 0 573 761; EPO 0 608 956; EPO 0 608 957; and EPO 0 628 865. Such couplers are typically open chain ketomethylene compounds.

Representative examples of coupler parent groups useful in the present invention, bearing hydrogen or a coupling-off groups at the open coupling position as shown, are as follows:

1A

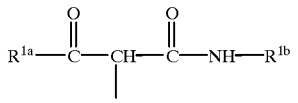

1B

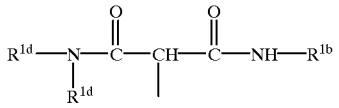

1C

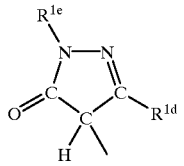

1D

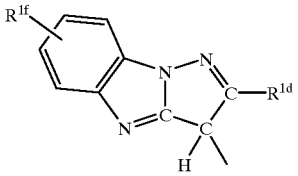

1E

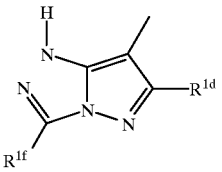

1F

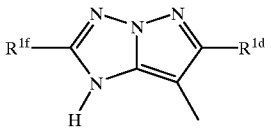

1G

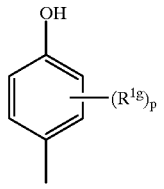

1H

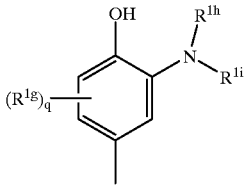

1I

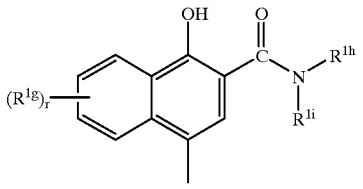

-continued

1J

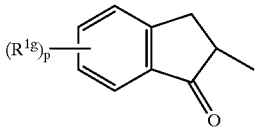

1K

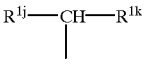

A free bond from the coupling site in the above formulae indicates a position to which the coupling release group or coupling-off group is linked. In the above formulae, when $R^{1a}$, $R^{1b}$, $R^{1c}$, $R^{1d}$, $R^{1e}$, $R^{1f}$, $R^{1g}$, $R^{1h}$, $R^{1i}$, $R^{1j}$, or $R^{1k}$ contains a ballast or antidiffusing group, it is selected so that the total number of carbon atoms is from 8 to 32 and preferably from 10 to 22.

$R^{1a}$ represents an aliphatic- or alicyclic-hydrocarbon group, an aryl group, an alkoxyl group, or a heterocyclic group, and $R^{1b}$ and $R^{1c}$ each represents an aryl group or a heterocyclic group.

The aliphatic- or alicyclic hydrocarbon group represented by $R^{1a}$ preferably has at most 22 carbon atoms, may be substituted or unsubstituted, and aliphatic hydrocarbon may be straight or branched. Preferred examples of the substituent for these groups represented by $R^{1a}$ are an alkoxy group, an aryloxy group, an amino group, an acylamino group, and a halogen atom. These substituents may be further substituted with at least one of these substituents repeatedly. Useful examples of the groups as $R^{1a}$ include an isopropyl group, an isobutyl group, a tert-butyl group, an isoamyl group, a tert-amyl group, a 1,1-dimethyl-butyl group, a 1,1-dimethylhexyl group, a 1,1-diethylhexyl group, a dodecyl group, a hexadecyl group, an octadecyl group, a cyclohexyl group, a 2-methoxyisopropyl group, a 2-phenoxyisopropyl group, a 2-p-tert-butylphenoxyisopropyl group, an α-aminoisopropyl group, an α-(diethylamino)isopropyl group, an α-(succinimido) isopropyl group, an α-(phthalimido)isopropyl group, an α-(benzenesulfonamido)isopropyl group, and the like.

When $R^{1a}$, $R^{1b}$, or $R^{1c}$ is an aryl group (especially a phenyl group), the aryl group may be substituted. The aryl group (e.g., a phenyl group) may be substituted with groups having not more than 32 carbon atoms such as an alkyl group, an alkenyl group, an alkoxy group, an alkoxycarbonyl group, an alkoxycarbonylamino group, an aliphatic- or alicyclic-amido group, an alkylsulfamoyl group, an alkylsulfonamido group, an alkylureido group, an aralkyl group and an alkyl-substituted succinimido group. This phenyl group in the aralkyl group may be further substituted with groups such as an aryloxy group, an aryloxycarbonyl group, an arylcarbamoyl group, an arylamido group, an arylsulfamoyl group, an arylsulfonamido group, and an arylureido group.

The phenyl group represented by $R^{1a}$, $R^{1b}$, or $R^{1c}$ may be substituted with an amino group which may be further substituted with a lower alkyl group having from 1 to 6 carbon atoms, a hydroxyl group, —COOM and —$SO_2M$ (M=H, an alkali metal atom, $NH_4$), a nitro group, a cyano group, a thiocyano group, or a halogen atom.

$R^{1a}$, $R^{1b}$, or $R^{1c}$ may represent substituents resulting from condensation of a phenyl group with other rings, such as a naphthyl group, a quinolyl group, an isoquinolyl group, a chromanyl group, a coumaranyl group, and a tetrahydronaphthyl group. These substituents may be further substituted repeatedly with at least one of above-described substituents for the phenyl group represented by $R^{1a}$, $R^{1b}$, or $R^{1c}$.

When $R^{1a}$ represents an alkoxy group, the alkyl moiety of the alkoxyl group can be a straight or branched alkyl group, an alkenyl group, a cycloalkyl group, or a cycloalkenyl group each having at most 32 carbon atoms, preferably at most 22 carbon atoms. These substituents may be substituted with groups such as halogen atom, an aryl group, and an alkoxyl group to form a group having at most 32 carbon atoms.

When $R^{1a}$, $R^{1b}$, or $R^{1c}$ represents a heterocyclic ring, the heterocyclic group is linked to a carbon atom of the carbonyl group of the acyl group in α-acylacetamido or to a nitrogen atom of the amido group through one of the carbon atoms constituting the ring. Examples of such heterocyclic rings are thiophene, furan, pyran, pyrrole, pyrazole, pyridine, pyrazine, pyrimidine, pyridazine, indolizine, imidazole, thiazole, oxazole, triazine, thiadiazine and oxazine. These groups may further have a substituent or substituents in the ring thereof. Examples of the substituents include those defined for the aryl group represented by $R^{1a}$, $R^{1b}$ and $R^{1c}$.

In formula (1C), $R^{1e}$ is a group having at most 32 carbon atoms, preferably at most 22 carbon atoms, and it is a straight or branched alkyl group (e.g., a methyl group, an isopropyl group, a tert-butyl group, a hexyl group and a dodecyl group), an alkenyl group (e.g., an allyl group), a cycloalkyl group (e.g., a cyclopentyl group, a cyclohexyl group and a norbornyl group), an aralkyl group (e.g., a benzyl group and a β-phenylethyl group), or a cycloalkenyl group (e.g., a cyclopentenyl group and a cyoloalkenyl group). These groups may be further substituted with groups such as a halogen atom, a nitro group, a cyano group, an aryl group, an alkoxyl group, an aryloxy group, —COOM (M=H, an alkali metal atom, $NH_4$) an alkylthiocarbonyl group, an arylthiocarbonyl group, an alkoxycarbonyl group, an aryloxycarbonyl group, a sulfo group, a sulfamoyl group, a carbamoyl group, an acylamino group, a diacylamino group, a ureido group, a urethane group, a thiourethane group, a sulfonamide group, a heterocyclic group, an arylsulfonyl group, an alkylsulfonyl group, an arylthio group, an alkylthio group, an alkylamino group, a dialkylamino group, an anilino group, an N-arylanilino group, an N-alkylanilino group, an N-acylanilino group, a hydroxyl group, and a mercapto group.

Furthermore $R^{1e}$ may represent an aryl group (e.g., a phenyl group and an α- or β-naphthyl group). This aryl group may be substituted with at least one group. Examples of such substituents are an alkyl group, an alkenyl group, a cycloalkyl group, an aralkyl group, a cycloalkenyl group, a halogen atom, a nitro group, a cyano group, an aryl group, an alkoxy group, an aryloxy group, —COOM (M=H, an alkali metal atom, $NH_4$), an alkoxycarbonyl group, an aryloxycarbonyl group, a sulfo group, a sulfamoyl group, a carbamoyl group, an acylamino group, a diacylamino group, a ureido group, a urethane group, a sulfonamido group, a heterocyclic group, an arylsulfonyl group, alkylsulfonyl group, an arylthio group, an alkylthio group, an alkylamino group, a dialkylamino group, an anilino group, an N-alkylanilino group, an N-arylanilino group, an N-acylanilino group, a hydroxyl group, and a mercapto group. More preferred as $R^{1e}$ is a phenyl group which is substituted with at least one of the groups such as an alkyl group, an alkoxyl group, and a halogen atom in at least one ortho-position, because it decreases color formation due to light or heat of the coupler remaining in a film member.

Furthermore, $R^{1e}$ may represent a heterocyclic group (e.g., 5- or 6-membered heterocyclic rings and condensed heterocyclic groups containing at least one hetero atom, i.e., a nitrogen atom, an oxygen atom or a sulfur atom such as a pyridyl group, a quinolyl group, a furyl group, a benzothiazolyl group, an oxazolyl group, an imidazolyl group, and a naphthooxazolyl group), a heterocyclic group substituted with a group as listed for the above aryl group represented by $R^{1e}$, an aliphatic, alicyclic or aromatic acyl group, an alkylsulfonyl group, an arysulfonyl group, an alkylcarbarmoyl group, an arylcarbamoyl group, an alkylthiocarbanoyl group, or an arylthiocarbamoyl group.

$R^{1d}$ represents a hydrogen atom, and represents groups having at most 32 carbon atoms, preferably at most 22 carbon atoms, such as a straight or branched alkyl group, an alkenyl group, a cycloalkyl group, an aralkyl group, a cycloalkenyl group (these groups may have a substituent or substituents as listed for $R^{1e}$), an aryl group, a heterocyclic group (these groups may have a substituent or substituents as listed for $R^{1e}$ an alkoxycarbonyl group (e.g., a methoxycarbonyl group, an ethoxycarbonyl group, and a stearyloxycarbonyl group), an aryloxycarbonyl group (e.g., a phenoxycarbonyl group and a naphthoxycarbonyl group), an aralkyloxycarbonyl group (e.g., a benzyloxycarbonyl group), an alkoxy group (e.g., a methoxy group, an ethoxy group, and a heptadecyloxy group), an aryloxy group (e.g., a phenoxy group and a tolyloxy group), an alkylthio group (e.g., an ethylthio group and a dodecylthio group), an arylthio group (e.g., a phenylthio group and an α-naphthylthio group), —COOM(M=H alkali metal atom $NH_4$), an acylamino group e.g., an acetylamino group and a 3-[(2,4-di-tert-amylphenoxy)acetamido]benzamido group), a diacylamino group, an N-alkylacylamino group (e.g., an N-methylpropionamido group), an N-arylacylamino group (e.g., an N-phenylacetamido group), a ureido group, a substituted ureido group (e.g., an N-arylureido group, and an N-alkylureido group), a urethane group, a thiourethane group, an arylamino group (e.g., a phenylamino group, an N-methylanilino group, a di-phenylamino group, an N-acetylanilino group, and a 2-chloro-5-tetradecaneamidoanilino group), an alkylamino group (e.g., an n-butylamino group, a methylamino group and a cyclohexylamino group), a cycloamino group (e.g., a piperidino group, and a pyrrolidino group), a heterocyclic amino group (e.g., a 4-pyridylamino group and a 2-benzooxazolidyl amino group), an alkylcarbonyl group (e.g., a methylcarbonyl group), an arylcarbonyl group (e.g., a phenylcarbonyl group), a sulfonamido group (e.g., an alkylsulfonamido group and an arylsulfonamido group), a carbamoyl group (e.g., an ethylcarbamoyl group, a dimethylcarbamoyl group an N-methyl-N-phenylcarbamoyl group and an N-phenylcarbamoyl group), a sulfamoyl group (e.g., an N-alkylsulfamoyl group, an N,N-dialkylsulfamoyl group, an N-arylsulfamoyl, an N-alkyl-N-arylsulfamoyl group, and an N,N-diarylsulfamoyl group), a cyano group, a hydroxyl group, a mercapto group, a halogen atom, or a sulfo group.

$R^{1f}$ represents a hydrogen atom, and represents groups having at most 32 carbon atoms, preferably at most 22 carbon atoms, such as a straight or branched alkyl group, an alkenyl group, a cycloalkyl group, an aralkyl group, or a cycloalkenyl group. These groups may be substituted with a group or groups as listed for $R^{1e}$.

$R^{1f}$ may be an aryl group or a heterocyclic group. These groups may be substituted with a group or groups as listed for $R^{1e}$.

$R^{1f}$ may be a cyano group, an alkoxyl group, an aryloxy group, a halogen atom, —COOM(M=H, an alkali metal atom, $NH_4$), an alkoxycarbonyl group, an aryloxycarbonyl group, an acyloxy group, a sulfo group, a sulfamoyl group, a carbarmoyl group, an acylamino group, a diacylamino group, a ureido group, a urethane group, a sulfonamido group, an arylsulfonyl group, an alkylsulfonyl group, an urylthio group, an alkylthio group, an alkylamino group, a dialkylamino group, an anilino group, an N-aryl-anilino group, an N-alkylanilino group, an N-acylanilino group, a hydroxyl group, or a mercapto group.

$R^{1g}$, $R^{1h}$, and $R^{1i}$ each represents a group as is conventionally used in 4-equivalent phenol or β-naphthol couplers $R^{1g}$, $R^{1h}$ and $R^{1i}$ each may have at most 32 carbon atoms, and preferably at most 22 carbon atoms.

More specifically, $R^{1g}$ represents a hydrogen atom, a halogen atom, an alkoxycarbonylamino group, an aliphatic or alicyclic-hydrocarbon group, an N-arylureido group, an acylamino group, a group —$R^{1l}$ or a group —S—$R^{1l}$ (wherein $R^{1l}$ is an aliphatic- or alicyclic-hydrocarbon radical). When two or more of the groups of $R^{1g}$ are contained in one molecule they may be different, and the aliphatic- and alicyclic-hydrocarbon radical may be substituted. In a case that these substituents contain an aryl group, the aryl group may be substituted with a group or groups as listed for $R^{1e}$.

$R^{1h}$ and $R^{1i}$ each represents a group selected from an aliphatic- or alicyclic-hydrocarbon radial, an aryl group, and a heterocyclic group, or one of $R^{1h}$ and $R^{1i}$ may be hydrogen atom. The above groups may be substituted. $R^{1h}$ and $R^{1i}$ may combine together to form a nitrogen-containing heterocyclic nucleus.

The aliphatic- and alicyclic-hydrocarbon radical may be saturated or unsaturated, and the aliphatic hydrocarbon may be straight or branched. Preferred examples are an alkyl group (e.g., a methyl group, an ethyl group, an isopropyl group, a butyl group, a tert-butyl group, an isobutyl group, a dodecyl group, an octadecyl group, a cyclobutyl group and a cyclohexyl group), and an alkenyl group (e.g., an alkyl group and an octenyl group). Typical examples of the aryl group are a phenyl group and a naphthyl group, and typical examples of the heterocyclic radical are a pyridinyl group, a quinolyl group, a thienyl group, a piperidyl group, and an imidazolyl group. Groups to be introduced in these aliphatic hydrocarbon radical, aryl group and heterocyclic radical include a halogen atom, a nitro group, a hydroxyl group, a carboxyl group, an amino group, a substituted amino group, a sulfo group, an alkyl group, an alkenyl group, an aryl group, a heterocyclic group, an alkoxy group, an aryloxy group, an arylthio group, an arylazo group, an acylamino group, a carbamoyl group, an ester group, an acyl group, an acyloxy group, a sulfonamido group, a sulfamoyl group, a sulfonyl group, and a morpholino group.

p is an integer of 1 to 4, q is an integer of 1 to 3, and r is an integer of 1 to 5.

$R^{1j}$ represents a group having at most 32 carbon atoms and preferably at most 22 carbon atoms. $R^{1j}$ represents an arylcarbonyl group, an alkanoyl group, an alkanecarbamoyl group, an alkoxycarbonyl group, or an aryloxycarbonyl group. These groups may be substituted with groups such as an alkoxyl group, an alkoxycarbonyl group, an acylamino group, an alkylsulfamoyl group, an alkylsulfonamido group, an alkylsuccinimide group, a halogen atom, a nitro group, a carboxyl group, a nitrile group, an alkyl group, and an aryl group.

$R^{1k}$ represents groups having at most 32 carbon atoms, and preferably at most 22 carbon atoms. $R^{1k}$ represents an arylcarbonyl group, an alkamoyl group, an arylcarbamoyl group, an alkanecarbamoyl group, an alkoxycarbonyl group, and aryloxycarbonyl group, and arylsulfonyl group, an arylsulfonyl group, an aryl group, or a 5- or 6-membered heterocyclic group (containing a hetero atom selected from a nitrogen atom, an oxygen atom, and a sulfur atom, e.g., a triazolyl group, an imidazolyl group, a phthalamido group, a succinamido group, a furyl group, a pyridyl group, and a benzotriazolyl group). These groups may be substituted with a group or groups as listed for $R^{1j}$.

The above-described substituted groups in formulae 1A–1K may be further substituted repeatedly once, twice, or more with a group selected from the same group of the substituents to form substituted groups having preferably at most 32 carbon atoms.

Another cyan coupler group suitable for the invention is

1

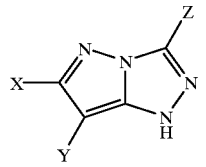

X=Electron withdrawing or H-bonding group

Y=H or coupling-off group

Z=Aryl or heterocyclic group

Preferred magenta couplers for use with the invention are

M-1A

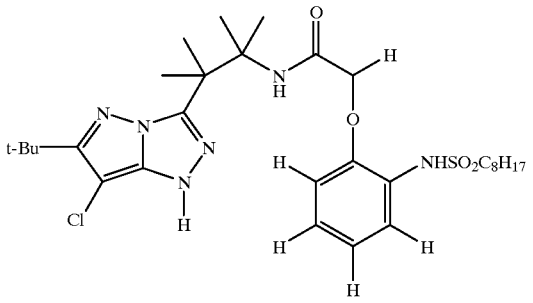

M-1B

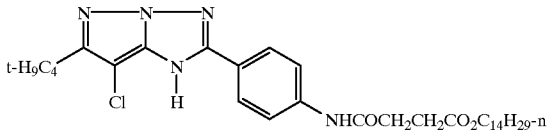

Preferred cyan couplers are

C-1
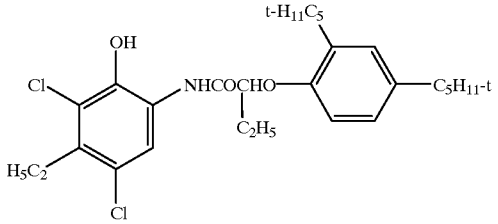
C-2
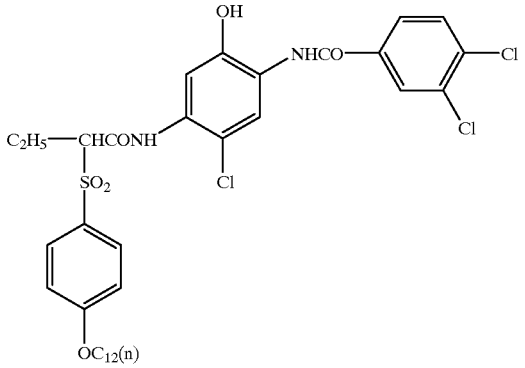
C-3
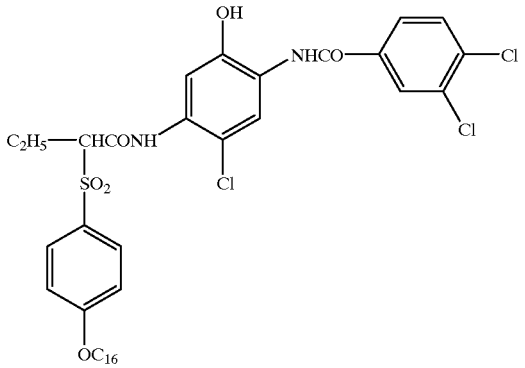
Preferred yellow couplers are
Y-1
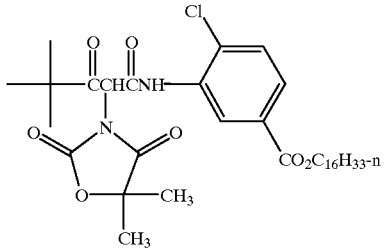
Y-2
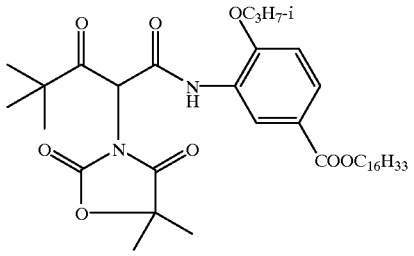

-continued

Y-3

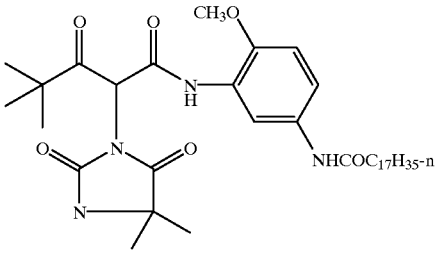

Y-4

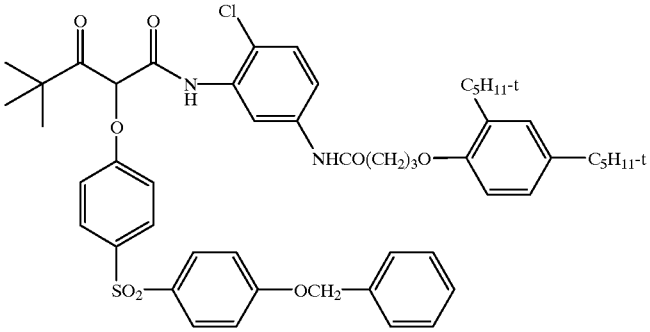

Y-5

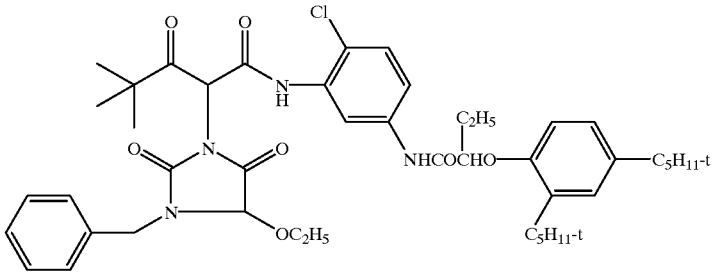

In order to successfully transport display materials of the invention, the reduction of static caused by web transport through manufacturing and image processing is desirable. Since the light sensitive imaging layers of this invention can be fogged by light from a static discharge accumulated by the web as it moves over conveyance equipment such as rollers and drive nips, the reduction of static is necessary to avoid undesirable static fog. The polymer materials of this invention have a marked tendency to accumulate static charge as they contact machine components during transport. The use of an antistatic material to reduce the accumulated charge on the web materials of this invention is desirable. Antistatic materials may be coated on the web materials of this invention and may contain any known materials in the art which can be coated on photographic web materials to reduce static during the transport of photographic paper. Examples of antistatic coatings include conductive salts and colloidal silica. Desirable antistatic properties of the support materials of this invention may also be accomplished by antistatic additives which are an integral part of the polymer layer. Incorporation of additives that migrate to the surface of the polymer to improve electrical conductivity include fatty quaternary ammonium compounds, fatty amines, and phosphate esters. Other types of antistatic additives are hygroscopic compounds such as polyethylene glycols and hydrophobic slip additives that reduce the coefficient of friction of the web materials. An antistatic coating applied to the opposite side of the image layer or incorporated into the backside polymer layer is preferred. The backside is preferred because the majority of the web contact during conveyance in manufacturing and photoprocessing is on the backside. The preferred surface resistivity of the antistat coat at 50% RH is less than $10^{13}$ ohm/square. A surface resistivity of the antistat coat at 50% RH of less than $10^{13}$ ohm/square has been shown to sufficiently reduce static fog in manufacturing and during photoprocessing of the image layers.

In the following Table, reference will be made to (1) *Research Disclosure*, December 1978, Item 17643, (2) *Research Disclosure*, December 1989, Item 308119, and (3) *Research Disclosure*, September 1996, Item 38957, all published by Kenneth Mason Publications, Ltd., Dudley Annex, 12a North Street, Emsworth, Hampshire PO10 7DQ, ENGLAND. The Table and the references cited in the Table are to be read as describing particular components suitable for use in the elements of the invention. The Table and its cited references also describe suitable ways of preparing, exposing, processing and manipulating the elements, and the images contained therein.

| Reference | Section | Subject Matter |
|---|---|---|
| 1 | I, II | Grain composition, |
| 2 | I, II, IX, X, XI, XII, XIV, XV | morphology and preparation. Emulsion preparation |

-continued

| Reference | Section | Subject Matter |
|---|---|---|
| | I, II, III, IX | including hardeners, coating |
| 3 | A & B | aids, addenda, etc. |
| 1 | III, IV | Chemical sensitization and |
| 2 | III, IV | spectral sensitization/ |
| 3 | IV, V | desensitization |
| 1 | V | UV dyes, optical brighteners, |
| 2 | V | luminescent dyes |
| 3 | VI | |
| 1 | VI | Antifoggants and stabilizers |
| 2 | VI | |
| 3 | VII | |
| 1 | VIII | Absorbing and scattering |
| 2 | VIII, XIII, XVI | materials; Antistatic layers; |
| 3 | VIII, IX C & D | matting agents |
| 1 | VII | Image-couplers and image- |
| 2 | VII | modifying couplers; Dye |
| 3 | X | stabilizers and hue modifiers |
| 1 | XVII | Supports |
| 2 | XVII | |
| 3 | XV | |
| 3 | XI | Specific layer arrangements |
| 3 | XII, XIII | Negative working emulsions; Direct positive emulsions |
| 2 | XVIII | Exposure |
| 3 | XVI | |
| 1 | XIX, XX | Chemical processing; |
| 2 | XIX, XX, XXII | Developing agents |
| 3 | XVIII, XIX, XX | |
| 3 | XIV | Scanning and digital processing procedures |

The photographic elements can be exposed with various forms of energy which encompass the ultraviolet, visible, and infrared regions of the electromagnetic spectrum, as well as with electron beam, beta radiation, gamma radiation, X rays, alpha particle, neutron radiation, and other forms of corpuscular and wavelike radiant energy in either noncoherent (random phase) forms or coherent (in phase) forms, as produced by lasers. When the photographic elements are intended to be exposed by X rays, they can include features found in conventional radiographic elements.

The photographic elements are preferably exposed to actinic radiation, typically in the visible region of the spectrum, to form a latent image, and then processed to form a visible image, preferably by other than heat treatment. Processing is preferably carried out in the known RA-4™ (Eastman Kodak Company) Process or other processing systems suitable for developing high chloride emulsions.

The following examples illustrate the practice of this invention. They are not intended to be exhaustive of all possible variations of the invention. Parts and percentages are by weight unless otherwise indicated.

EXAMPLES

Example 1

In this example two invention photographic elements were constructed by laminating biaxially oriented sheets to cellulose photographic grade paper. The first photographic element invention, labeled photographic element "A", is representative of a valid quality photographic paper. The second photographic element invention, labeled photographic element "B", is representative of a premium photographic paper that has many consumer features beyond typical low cost photographic paper. This example will show the functionality of photographic element "A" compared to the commercially available Kodak Edge 7 photographic paper, which is representative of typical low cost, color photographic papers. This example will also show the superior features of photographic element "B" when compared to Kodak Royal, which is representative of prior art premium photographic papers presently available commercially. Both the prior art value and premium photographic papers used as a control utilize typical polyethylene melt extrusion coated cellulose paper.

The following is a description of photographic element A (invention) and was prepared by extrusion laminating the following top and bottom biaxially oriented sheet to the cellulose paper described below:

Top Sheet (Emulsion Side)

A composite sheet consisting of 5 layers identified as L1, L2, L3, L4, and L5. L1 is the thin colored layer on the outside of the package to which the photosensitive silver halide layer was attached. L2 is the layer to which optical brightener and $TiO_2$ was added. The optical brightener used was Hostalux KS manufactured by Ciba-Geigy. The rutile $TiO_2$ used was DuPont R104 (a 0.22 $\mu$m particle size $TiO_2$). Table 1 below lists the characteristics of the layers of the top biaxially oriented sheet used in this example.

TABLE 1

| Layer | Material | Thickness, $\mu$m |
|---|---|---|
| L1 | LD Polyethylene + color concentrate | 0.75 |
| L2 | Polypropylene + 18% $TiO_2$ | 4.6 |
| L3 | Voided Polypropylene | 25.1 |
| L4 | Polypropylene | 4.6 |
| L5 | Polypropylene | 0.76 |

Photographic Grade Cellulose Paper Base Used to Construct Photographic Element A (Invention)

Paper base was produced for photographic element A using a standard fourdrinier paper machine and a blend of mostly bleached hardwood Kraft fibers. The fiber ratio consisted primarily of bleached poplar (38%) and maple/beech (37%) with lesser amounts of birch (18%) and softwood (7%). Fiber length was reduced from 0.73 mm length weighted average as measured by a Kajaani FS-200 to 0.55 mm length using high levels of conical refining and low levels of disc refining. Fiber Lengths from the slurry were measured using a FS-200 Fiber Length Analyzer (Kajaani Automation Inc. ). Energy applied to the fibers indicated by the total Specific Net Refining Power (SNRP) was 115 KW hr/metric ton. Two conical refiners were used in series to provide the total conical refiners SNRP value. This value was obtained by adding the SNRPs of each conical refiner. Two disc refiners were similarly used in series to provide a total Disk SNRP. Neutral sizing chemical addenda, utilized on a dry weight basis, included alkyl ketene dimer at 0.20% addition, cationic starch (1.0%), polyaminoamide epichlorhydrin (0.50%), polyacrylamide resin (0.18%), diaminostilbene optical brightener (0.20%), and sodium bicarbonate. Surface sizing using hydroxyethylated starch and sodium chloride was also employed but is not critical to the invention. In the 3$^{rd}$ Dryer section, ratio drying was utilized to provide a moisture bias from the face side to the wire side of the sheet. The face side (emulsion side) of the sheet was then remoisturized with conditioned steam immediately prior calendering. Sheet temperatures were raised to between 76° C. and 93° C. just prior to and during calendering. The paper was then calendered to an apparent density of 1.06 Moisture levels after the calender was 7.0% to 9.0% by weight. Paper base A was produced at a basis weight of 127 g/m$^2$ and thickness of 0.1194 mm.

The top sheet used in this example was coextruded and biaxially oriented. The top sheet was melt extrusion laminated to the above cellulose paper base using a metallocene catalyzed ethylene plastomer (SLP 9088) manufactured by Exxon Chemical Corp. The metallocene catalyzed ethylene plastomer had a density of 0.900 g/cc and a melt index of 14.0.

The L3 layer for the biaxially oriented sheet is microvoided and further described in Table 2 where the refractive index and geometrical thickness is shown for measurements made along a single slice through the L3 layer; they do not imply continuous layers; a slice along another location would yield different but approximately the same thickness. The areas with a refractive index of 1.0 are voids that are filled with air and the remaining layers are polypropylene.

TABLE 2

| Sublayer of L3 | Refractive Index | Thickness, μm |
|---|---|---|
| 1 | 1.49 | 2.54 |
| 2 | 1 | 1.527 |
| 3 | 1.49 | 2.79 |
| 4 | 1 | 1.016 |
| 5 | 1.49 | 1.778 |
| 6 | 1 | 1.016 |
| 7 | 1.49 | 2.286 |
| 8 | 1 | 1.016 |
| 9 | 1.49 | 2.032 |
| 10 | 1 | 0.762 |
| 11 | 1.49 | 2.032 |
| 12 | 1 | 1.016 |
| 13 | 1.49 | 1.778 |
| 14 | 1 | 1.016 |
| 15 | 1.49 | 2.286 |

The following is a description of photographic element B (invention) and was prepared by extrusion laminating the following top and bottom biaxally oriented sheet to the cellulose paper described below:

Top Sheet (Emulsion Side)

A composite sheet consisting of 5 layers identified as L1, L2, L3, L4, and L5. L1 is the thin colored layer on the outside of the package to which the photosensitive silver halide layer was attached. L2 is the layer to which optical brightener and $TiO_2$ was added. The optical brightener used was Hostalux KS manufactured by Ciba-Geigy. A coated extrusion grade anatase $TiO_2$ was added to beth L2 and L4. Table 3 below lists the characteristics of the layers of the top biaxially oriented sheet used in this example.

TABLE 3

| Layer | Material | Thickness, μm |
|---|---|---|
| L1 | LD Polyethylene + color concentrate | 0.75 |
| L2 | Polypropylene + 24% $TiO_2$ + OB | 6.65 |
| L3 | Voided Polypropylene | 21 |
| L4 | Polypropylene + 18% $TiO_2$ | 6.85 |
| L5 | Polypropylene | 0.76 |

Photographic Grade Cellulose Paper Base Used in Photographic Element B (Invention)

Paper base was produced for photographic element B using a standard fourdrinier paper machine and a blend of mostly bleached hardwood Kraft fibers. The fiber ratio consisted primarily of bleached poplar (38%) and maple/beech (37%) with lesser amounts of birch (18%) and softwood (7%). Fiber length was reduced from 0.73 mm length weighted average as measured by a Kajaani FS-200 to 0.55 mm length using high levels of conical refining and low levels of disc refining. Fiber Lengths from the slurry were measured using a FS-200 Fiber Length Analyzer (Kajaani Automation Inc. ). Energy applied to the fibers is indicated by the total Specific Net Refining Power (SNRP) was 127 KW hr/metric ton. Two conical refiners were used in series to provide the total conical refiners SNRP value. This value was obtained by adding the SNRPs of each conical refiner. Two disc refiners were similarly used in series to provide a total Disk SNRP. Neutral sizing chemical addenda, utilized on a dry weight basis, included alkyl ketene dimer at 0.20% addition, cationic starch (1.0%), polyaminoamide epichlorhydrin (0.50%), polyacrylamide resin (0.18%), diaminostilbene optical brightener (0.20%), and sodium bicarbonate. Surface sizing using hydroxyethylated starch and sodium chloride was also employed but is not critical to the invention. In the 3$^{rd}$ Dryer section, ratio drying was utilized to provide a moisture bias from the face side to the wire side of the sheet. The face side (emulsion side) of the sheet was then remoisturized with conditioned steam immediately prior calendering. Sheet temperatures were raised to between 76° C. and 93° C. just prior to and during calendering. The paper was then calendered to an apparent density of 1.17. Moisture levels after the calender were 7.0% to 9.0% by weight. Paper base B was produced at a basis weight of 178 g/mm$^2$ and thickness of 0.1524 mm.

The bottom biaxially oriented sheet laminated to the backside of photographic bases A and B was a one-side matte finish, one-side treated biaxially oriented polypropylene sheet (25.6 μm thick) (d=0.90 g/cc) consisting of a solid oriented polypropylene layer and a skin layer of a block copolymer of polyethylene and a terpolymer comprising ethylene, propylene, and butylene. The skin layer was on the bottom and the polyproylene layer and laminated to the paper.

The top sheet used in this example was coextruded and biaxially oriented. The top sheet was melt extrusion laminated to the above cellulose paper base using a metallocene catalyzed ethylene plastomer (SLP 9088) manufactured by Exxon Chemical Corp. The metallocene catalyzed ethylene plastomer had a density of 0.900 g/cc and a melt index of 14.0.

A coating was then applied to the laminated bottom biaxially oriented sheet on invention bases A and B using a gravure coater to add the high frequency roughness to the backside. The coating consisted of an aqueous solution containing a sodium salt of styrene sulfonic acid. The coverage used was 25 mg per square meter and then dried to achieve a final web temperature between 55° C., the resultant coalesced latex material produced the desired high frequency roughness pattern. In addition to the sodium salt of styrene sulfonic acid, aluminum modified colloidal silicon dioxide particles were added to the aqueous latex material at a concentration of 50 milligrams per square meter. This further enhanced the high frequency roughness.

The L3 layer for the biaxially oriented sheet is microvoided and further described in Table 4 where the refractive index and geometrical thickness is shown for measurements made along a single slice through the L3 layer; they do not imply continuous layers, a slice along another location would yield different but approximately the same thickness. The areas with a refractive index of 1.0 are voids that are filled with air and the remaining layers are polypropylene.

TABLE 4

| Sublayer of L3 | Refractive Index | Thickness, μm |
|---|---|---|
| 1 | 1.49 | 2.54 |
| 2 | 1 | 1.527 |
| 3 | 1.49 | 2.79 |

TABLE 4-continued

| Sublayer of L3 | Refractive Index | Thickness, μm |
|---|---|---|
| 4 | 1 | 1.016 |
| 5 | 1.49 | 1.778 |
| 6 | 1 | 1.016 |
| 7 | 1.49 | 2.286 |
| 8 | 1 | 1.016 |
| 9 | 1.49 | 2.032 |
| 10 | 1 | 0.762 |
| 11 | 1.49 | 2.032 |
| 12 | 1 | 1.016 |
| 13 | 1.49 | 1.778 |
| 14 | 1 | 1.016 |
| 15 | 1.49 | 2.286 |

Coating format 1 was utilized to prepare photographic print materials utilizing photographic supports A and B.

| Coating Format 1 | Laydown mg/m$^2$ |
|---|---|
| Layer 1 Blue Sensitive Layer | |
| Gelatin | 1300 |
| Blue sensitive silver | 200 |
| Y-1 | 440 |
| ST-1 | 440 |
| S-1 | 190 |
| Layer 2 Interlayer | |
| Gelatin | 650 |
| SC-1 | 55 |
| S-1 | 160 |
| Layer 3 Green Sensitive | |
| Gelatin | 1100 |
| Green sensitive silver | 70 |
| M-1 | 270 |
| S-1 | 75 |
| S-2 | 32 |
| ST-2 | 20 |
| ST-3 | 165 |
| ST-4 | 530 |
| Layer 4 UV Interlayer | |
| Gelatin | 635 |
| UV-1 | 30 |
| UV-2 | 160 |
| SC-1 | 50 |
| S-3 | 30 |
| S-1 | 30 |
| Layer 5 Red Sensitive Layer | |
| Gelatin | 1200 |
| Red sensitive silver | 170 |
| C-1 | 365 |
| S-1 | 360 |
| UV-2 | 235 |
| S-4 | 30 |
| SC-1 | 3 |
| Layer 6 UV Overcoat | |
| Gelatin | 440 |
| UV-1 | 20 |
| UV-2 | 110 |
| SC-1 | 30 |
| S-3 | 20 |
| S-1 | 20 |
| Layer 7 SOC | |
| Gelatin | 490 |
| SC-1 | 17 |
| $SiO_2$ | 200 |
| Surfactant | 2 |

APPENDIX

Y-1

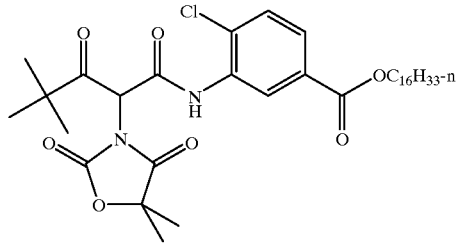

ST-1 = N-tert-butylacrylamide/n-butyl acrylate copolymer (50:50)

S-1 = dibutyl phthalate

SC-1

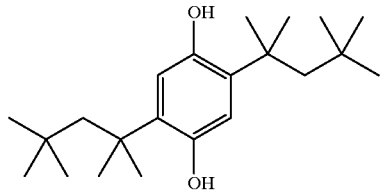

M-1

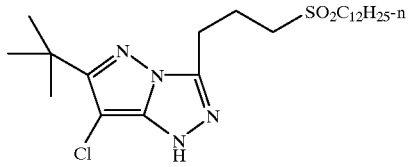

S-2 = diundecyl phthalate

ST-2

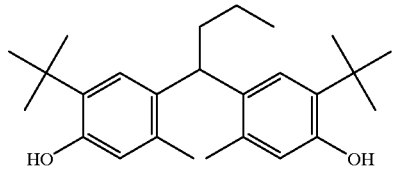

ST-3

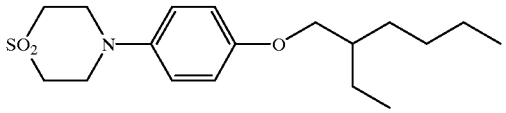

ST-4

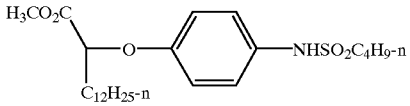

UV-1

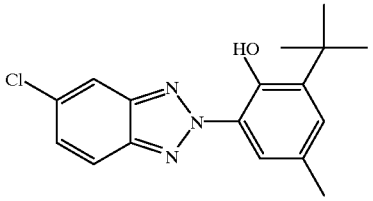

-continued

UV-2

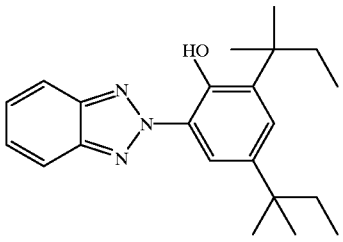

S-3 = 1,4-Cyclohexyldimethylene bis(2-ethylhexanoate)

C-1

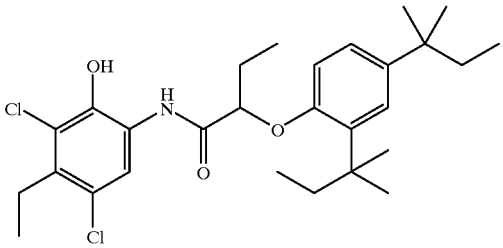

S-4 = 2-(2-Butoxyethoxy)ethyl acetate

Dye 1

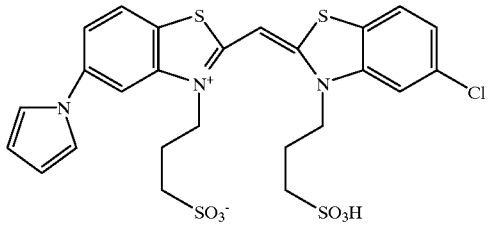

The structure of invention photographic element invention A (value quality paper) was the following:

| |
|---|
| Coating Format 1 |
| Top biaxially oriented, microvoided polyolefin sheet with $TiO_2$, blue tint and optical brightener |
| Ethylene plastomer |
| Cellulose paper base with basis weight of 127 g/m$^2$ |
| Ethylene plastomer |
| Bottom biaxially oriented polyolefin sheet |
| Sodium salt of styrene sulfonic acid |

The structure of photographic element invention B (premium paper) was the following:

| |
|---|
| Coating Format 1 |
| Top biaxially oriented, microvoided polyolefin sheet with $TiO_2$, blue tint and optical brightener |
| Ethylene plastomer with 14% anatase $TiO_2$ |
| Cellulose paper base with 2% rutile $TiO_2$, 178 g/m$^2$ basis weight and 0.10% blue dye |
| Ethylene plastomer |
| Bottom biaxially oriented polyolefin sheet sodium salt of styrene sulfonic acid |

The two invention materials (photographic elements A and B) and the prior art color photographic paper (Edge & and Royal) were measured for MD/CD stiffness, Federal profiler, Thickness, L*, opacity, MTF, tear resistance, photographic processing back marking, and writability curl at 70% RH. The bending stiffness of the polyester base and the laminated display material support were measured by using the Lorentzen and Wettre stiffness tester, Model 16D. The output from this instrument is force, in millinewtons, required to bend the cantilevered, unclasped end of a sample 20 mm long and 38.1 mm wide at an angle of 15 degrees from the unloaded position. In this test the stiffness in both the machine direction and cross direction of the photographic element A and B was compared to the stiffness of typical low cost and premium photographic paper. L* or lightness and opacity was measured for using a Spectrogard spectrophotometer, CIE system, using illuminant D6500.

The surface roughness of the emulsion side of each photographic element was measured by a Federal Profiler at three stages of sample preparation, in the paper base form, after extrusion lamination and after silver halide emulsion coating. The Federal Profiler instrument consists of a motorized drive nip which is tangent to the top surface of the base plate. The sample to be measured is placed on the base plate and fed through the nip. A micrometer assembly is suspended above the base plate. The end of the mic spindle provides a reference surface from which the sample thickness can be measured. This flat surface is 0.95 cm diameter and, thus, bridges all fine roughness detail on the upper surface of the sample. Directly below the spindle, and nominally flush with the base plate surface, is a moving hemispherical stylus of the gauge head. This stylus responds to local surface variation as the sample is transported through the gauge. The stylus radius relates to the spatial content that can be sensed. The output of the gauge amplifier is digitized to 12 bits. The sample rate is 500 measurements per 2.5 cm. The thickness of the product was measured with a Mitutoyo digital linear gauge using a measurement probe head of 20 mm$^2$.

The curl test measured the amount of curl in a parabolically deformed sample. A 8.5 cm diameter round sample of the composite was stored at the test humidity for 21 days. The amount of time required depends on the vapor barrier properties of the laminates applied to the moisture sensitive paper base, and it should be adjusted as necessary by determining the time to equilibrate the weight of the sample in the test humidity. The curl readings are expressed in ANSI curl units, specifically, 100 divided by the radius of curvature in inches. The radius of curvature is determined by mounting the sample perpendicular to the measurement surface, visually comparing the curled shape, sighting along the axis of curl, with standard curves in the background. The standard deviation of the test is 2 curl units. The curl may be positive or negative, and for photographic products, the usual convention is that the positive direction is curling towards the photosensitive layer.

Sharpness, or the ability to replicate fine details of the image, was measured by mathematical calculations utilizing a method is called the MTF or Modulation Transfer Function. In this test, a fine repeating sinusoidal pattern of photographic density variation near the resolution of the human eye was exposed on a photographic print. When the image was developed, the resulting density variation was compared to the expected density, and a ratio was obtained to determine the magnitude of the transfer coefficient at that frequency. A number of 100 denotes perfect replication, and this number was relatively easy to obtain at spatial frequencies of 0.2 cycle/mm. At a finer spacing of 2.0 cycles/mm, typical color photographic prints have a 70 rating or 70% replication.

Tear resistance for the photographic elements is the moment of force required to start a tear along an edge of the photographic element. The tear resistance test used was originally proposed by G. G. Gray and K. G. Dash, Tappi Journal 57, pages 167–170 published in 1974. The tear resistance for the photographic elements is determined by the tensile strength and the stretch of the photographic element. A 15 mm×25 mm sample is looped around a metal cylinder with a 2.5 cm diameter. The two ends of the sample are clamped by an Instron tensile tester. A load is applied to the sample at a rate of 2.5 cm per minuet until a tear is observed at which time the load, expressed in N, is recorded.

Testing the photographic elements for writability, the writing instruments used included a No. 2 pencil, ballpoint pen, water based ink pen, and solvent based ink pen. The most desired position is for legibility with all writing instruments used in the test. Photofinishing backmark tests were done using a dot matrix printer that is commonly used in the photoprocessing trade along with a printer ribbon which contained the ink material for transfer. The back marks were applied and subjected to physical abrasion and the color paper processing chemistry. The most desirable position is a minimal reduction in legibility.

The test results for the above tests are listed in Table 5 below.

TABLE 5

| | Photographic Element A | Low Cost Control (Kodak Edge 7) | Photographic Element B | Premium Control (Kodak Royal) |
|---|---|---|---|---|
| MD Stiffiness (millinewtons) | 154 | 173 | 210 | 281 |
| CD Stiffiness (millinewtons) | 147 | 94 | 207 | 147 |
| Federal Profiler (micrometers) | 0.25 | 0.53 | 0.2 | 0.46 |
| Thickness (micrometers) | 200 | 215 | 238 | 270 |
| L* | 93 | 93 | 94.2 | 93.5 |
| Opacity | 93 | 93 | 95.5 | 94.5 |
| MTF | 73 | 71 | 81 | 74 |
| Tear Strength (N) | 653 | 129 | 707 | 143 |
| Curl at 70% RH | 2 | 29 | 3 | 32 |
| Back marking | Excellent | Good | Excellent | Good |
| Writability | Excellent | Good | Excellent | Good |

The data above comparing photographic element "A" of the invention is clearly superior to the low cost color photographic paper control. The MD/CD stiffness for the invention is balanced; that is, the MD and CD stiffness are roughly equal creating a photographic image that is balanced in stiffness which is perceptually preferred over the control photographic paper which is much stronger in the machine direction compared the cross direction. A Federal Profiler surface roughness of 0.25 $\mu$m for the invention is showing a superior reflective surface substantially free of undesirable orange peel surface compared to the control. The thickness of the invention is 15 $\mu$m less than the control material. A reduction in thickness will result in lower cost compared to the control. The invention materials will be lighter and more efficiently stored by consumers. The tear resistance of photographic element "A" is significantly improved over the low cost control material resulting in improved image durability compared to the low cost control material.

The L* and opacity for the photographic element "A" are consistent with a quality image. Because of the concentration of $TiO_2$, photographic element "A" has a higher image sharpness than the control materials leading to a higher quality image. The tear strength for photographic element "A" is significantly higher than the control material, increasing the durability of the invention. The curl for photographic element "A" is significantly less compared to the control material resulting in more efficient consumer viewing, as flat reflective images consistently reflect ambient light compared to curled images. The back marking and the writability of photographic element "A" is better than the control material, allowing more efficient storage of information of the image. The integration of the above advantages creates a photographic print material that is superior to prior art low cost photographic papers. Finally, the superior feature advantage of the photographic element "A" compared to typical reflective photographic papers has significant value to the consumer and thus significant commercial value. The data above comparing photographic element "B" of the invention are clearly superior to the premium color photographic paper control. The MD/CD stiffness for the invention is balanced; that is, the MD and CD stiffness is roughly equal creating a photographic image that is balanced in stiffness which is perceptually preferred over the control photographic paper which is much stronger in the machine direction compared the cross direction. Further the balanced stiffness of photographic element "B" allows for more efficient photographic processing of images, as prior art photographic paper frequently suffers from conveyance problems, as the machine direction stiffness is at the upper limit of some photographic processing equipment. A Federal Profiler surface roughness of 0.20 $\mu$m for the invention is showing a superior reflective surface substantially free of undesirable orange peel surface compared to the control. The thickness of the invention is 32 $\mu$m less than the control material. A reduction in thickness will result in lower cost compared to the control. The invention materials will be lighter and more efficiently stored by consumers and vendors. The tear resistance of photographic element "B" (707 N) is significantly improved over the premium control material (143 N) resulting in improved image durability compared to the premium control material.

The L* and opacity for the photographic element "B" are significantly improved. Because of the concentration and increased loading of $TiO_2$, photographic element "B" has a higher image sharpness and opacity than the control materials leading to an improvement in quality image. Additionally, the improvement in opacity for the invention allows an increase in ink density for the printing used to brand photographic paper. The tear strength for photographic element "B" is significantly higher than the control material, increasing the durability of the invention which is consistent with the expected life of a photographic paper. The curl for photographic element "B" is significantly less compared to the control material, resulting in more efficient consumer viewing as flat reflective images consistently reflect ambient light compared to curled images. The back marking and the writability of photographic element "B" is better than the control material, allowing more efficient storage of information of the image. The integration of the above advantages creates a photographic print material that is superior to prior art premium photographic papers. Finally, the superior feature advantage of the photographic element "B" compared to premium reflective photographic papers has significant value to the consumer and thus significant commercial value.

The invention has been described in detail with particular reference to certain preferred embodiments thereof, but it will be understood that variations and modifications can be effected within the spirit and scope of the invention.

What is claimed is:

1. A photographic element comprising at least one photosensitive silver halide layer comprising at least one dye forming coupler, a support comprising paper having laminated thereto a top and bottom sheet comprising biaxially oriented polyolefin sheets, wherein said photographic element has a surface roughness of between 0.15 and 0.50 mm and an average stiffness of between 150 and 300 millinewtons, a stiffness ratio between machine direction and cross direction of between 0.8 and 1.2 at between 20 and 70% humidity, a maximum curl value of 10 curl units, said photographic element has a back roughness of between 0.30 and 2.00 mm, and has a tear strength of between 300 and 900 N.

2. The paper of claim 1 wherein the average fiber length of the individual fibers of said paper is between 0.40 and 0.58 mm.

3. The photographic element of claim 1 wherein said photographic element has a yellow layer density difference of less than 0.02 at a pressure of 206 MPa.

4. The photographic element of claim 1 wherein said element comprises a hindered amine light stabilizer at a level of between 0.1 and 0.5 percent by weight of the top biaxially oriented polyolefin sheet.

5. The photographic element of claim 1 wherein said element has an energy to break of less than $4.0\times10^7$ joules per cubic meter.

6. The photographic element of claim 1 wherein said element is provided with a copy protection feature.

7. The photographic element of claim 1 wherein said element is provided with at least one layer having a writable magnetic layer.

8. The photographic element of claim 1 wherein said element is provided with a layer having opalescent properties.

9. The photographic element of claim 1 wherein said element is provided with at least one layer that is a barrier layer to the passage of oxygen.

10. The photographic element of claim 9 wherein said oxygen barrier layer is between said paper support and said at least one layer containing silver halide.

11. The photographic element of claim 1 wherein said element is provided with a layer that is a barrier to the passage of water vapor.

12. The photographic element of claim 11 wherein said water vapor barrier is located between said at least one layer comprising silver halide and the top of said paper base, and comprises polyvinylidene chloride.

13. The photographic element of claim 1 wherein said upper biaxially oriented polyolefin sheet comprises at least five layers wherein the top layer comprises polyethylene and a blue colorant, and a core layer comprising microvoided polypropylene, wherein the microvoided layer has between 8 and 30 microvoids in the vertical direction.

14. The photographic element of claim 13 wherein there is located between said surface layer and said core at least one layer comprising hindered amine light stabilizer, titanium dioxide, and optical brightener.

15. The photographic element of claim 13 wherein metallocene catalyzed ethylene plastomer is located between said biaxially oriented polyolefin sheets and said paper support.

16. The photographic element of claim 13 wherein said lower biaxially oriented polyolefin sheet comprises at least two layers wherein the bottom layer a mixture of polyethylenes and a terpolymer of ethylene-propylene-butylene.

17. The photographic element of claim 1 wherein said paper support has a surface roughness of between 0.02 and 0.30 $\mu$m, an apparent density of between 1.05 and 1.20 grams per cc, a thickness of between 77 and 135 $\mu$m, and a Young's modulus of at least 800,000 MPa.

18. A photographic element comprising at least one photosensitive silver halide layer comprising at least one dye forming coupler, a support comprising paper having laminated thereto a top and bottom sheet comprising biaxially oriented polyolefin sheets, wherein said photographic element has a surface roughness of between 0.02 and 0.30 $\mu$m and an average stiffness of between 180 and 220 millinewtons, a stiffness ratio between machine direction and cross direction of between 0.8 and 1.2 at between 20 and 70% humidity, a maximum curl value of 10 curl units, said photographic element has a back roughness of between 0.30 and 2.00 $\mu$m, has a tear strength of between 300 and 900 N, a sharpness of greater than 78 MTF, an opacity of greater than 95.0, and a whiteness greater than 94.

19. The photographic element of claim 18 wherein said bottom biaxially oriented polyolefin sheet is provided with color indicia.

20. The paper of claim 18 wherein the average fiber length of the individual fibers of said paper is between 0.40 and 0.58 mm.

21. The photographic element of claim 18 wherein said photographic element has a yellow layer density difference of less than 0.02 at a pressure of 206 MPa.

22. The photographic element of claim 18 wherein said element comprises a hindered amine light stabilizer at a level of between 0.1 and 0.5 percent by weight of the top biaxially oriented polyolefin sheet.

23. The photographic element of claim 18 wherein said element has an energy to break of less than $4.0\times10^7$ joules per cubic meter.

24. The photographic element of claim 18 wherein said element is provided with a copy protection feature.

25. The photographic element of claim 18 wherein said element is provided with at least one layer having a writable magnetic layer.

26. The photographic element of claim 18 wherein said element is provided with a layer having opalescent properties.

27. The photographic element of claim 18 wherein said element is provided with at least one layer that is a barrier layer to the passage of oxygen.

28. The photographic element of claim 27 wherein said oxygen barrier layer is between said paper support and said at least one layer containing silver halide.

29. The photographic element of claim 28 wherein said element is provided with a layer that is a barrier to the passage of water vapor.

30. The photographic element of claim 29 wherein said water vapor barrier is located between said at least one layer comprising silver halide and the top of said paper base, and comprises polyvinylidene chloride.

31. The photographic element of claim 18 wherein said upper biaxially oriented polyolefin sheet comprises at least five layers wherein the top layer comprises polyethylene and a blue colorant, and a core layer comprising microvoided polypropylene, wherein the microvoided layer has between 8 and 30 microvoids in the vertical direction.

32. The photographic element of claim 18 wherein there is located between said surface layer and said core at least one layer comprising hindered amine light stabilizer, titanium dioxide, and optical brightener.

33. The photographic element of claim 18 wherein metallocene catalyzed ethylene plastomer is located between said biaxially oriented polyolefin sheets and said paper support.

34. The photographic element of claim 18 wherein said lower biaxially oriented polyolefin sheet comprises at least two layers wherein the bottom layer a mixture of polyethylenes and a terpolymer of ethylene-propylene-butylene.

35. The photographic element of claim 18 wherein said paper support has a surface roughness of between 0.02 and 0.30 $\mu$m, an apparent density of between 1.05 and 1.20 grams per cc, a thickness of between 130 and 180 $\mu$m, and a Young's modulus of at least 800,000 MPa.

36. A imaging element comprising at least one ink or dye receiving layer, a support comprising paper having laminated thereto a top and bottom sheet comprising biaxially oriented polyolefin sheets, wherein said imaging element has a surface roughness of between 0.15 and 0.50 mm and an average stiffness of between 150 and 300 millinewtons, a stiffness ratio between machine direction and cross direction of between 0.8 and 1.2 at between 20 and 70% humidity, a maximum curl value of 10 curl units, said imaging element has a back roughness of between 0.30 and 2.00 mm, and has a tear strength of between 300 and 900 N.

37. A photographic element comprising at least one ink or dye receiving layer, a support comprising paper having laminated thereto a top and bottom sheet comprising biaxially oriented polyolefin sheets, wherein said imaging element has a surface roughness of between 0.02 and 0.30 $\mu$m and an average stiffness of between 180 and 220 millinewtons, a stiffness ratio between machine direction and cross direction of between 0.8 and 1.2 at between 20 and 70% humidity, a maximum curl value of 10 curl units, said imaging element has a back roughness of between 0.30 and 2.00 $\mu$m, has a tear strength of between 300 and 900 N, a sharpness of greater than 78 MTF, an opacity of greater than 95.0, and a whiteness greater than 94.

* * * * *